US006673442B2

(12) United States Patent
Johnson et al.

(10) Patent No.: US 6,673,442 B2
(45) Date of Patent: Jan. 6, 2004

(54) MULTILOBAL POLYMER FILAMENTS AND ARTICLES PRODUCED THEREFROM

(75) Inventors: Stephen B. Johnson, Wilmington, NC (US); H. Vaughn Samuelson, Chadds Ford, PA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/863,166

(22) Filed: May 23, 2001

(65) Prior Publication Data

US 2003/0003299 A1 Jan. 2, 2003

Related U.S. Application Data

(60) Provisional application No. 60/206,980, filed on May 25, 2000.

(51) Int. Cl.[7] ..... D01F 6/00

(52) U.S. Cl. ..... 428/364; 428/394; 428/397

(58) Field of Search ..... 428/364, 394, 428/397; 57/140

(56) References Cited

U.S. PATENT DOCUMENTS

| | | | |
|---|---|---|---|
| 2,939,201 | A | 6/1960 | Holland |
| 3,097,416 | A | 7/1963 | McKinney |
| 3,454,460 | A | 7/1969 | Bosley |
| 3,508,390 | A | 4/1970 | Bagnall et al. |
| 3,691,749 | A | 9/1972 | McKay |
| 3,994,122 | A | 11/1976 | Shah |
| 4,040,689 | A | 8/1977 | Stanely |
| 4,041,689 | A | 8/1977 | Duncan et al. |
| 4,058,967 | A | 11/1977 | Iimuro et al. |
| 4,156,071 | A | 5/1979 | Knox |
| 4,529,368 | A | 7/1985 | Makansi |
| 4,687,610 | A | 8/1987 | Vassilatos |
| 4,691,003 | A | 9/1987 | Sze |
| 5,034,182 | A | 7/1991 | Sze et al. |
| 5,104,725 | A | 4/1992 | Broaddus |
| 5,108,838 | A | 4/1992 | Tung |
| 5,141,700 | A | 8/1992 | Sze |
| 5,168,143 | A | 12/1992 | Kobsa et al. |
| 5,176,926 | A | 1/1993 | Tung |
| 5,208,106 | A | 5/1993 | Tung |
| 5,250,245 | A | 10/1993 | Collins et al. |
| 5,288,553 | A | 2/1994 | Collins et al. |
| 5,559,205 | A | 9/1996 | Hansen et al. |
| 5,607,765 | A | 3/1997 | Hansen et al. |
| 5,741,587 | A | 4/1998 | Bennie et al. |
| 5,824,248 | A | 10/1998 | Sweet et al. |
| 5,827,464 | A | 10/1998 | Bennie et al. |
| 5,948,528 | A | 9/1999 | Holms et al. |

FOREIGN PATENT DOCUMENTS

WO WO 01/90452 A1 * 11/2001

* cited by examiner

*Primary Examiner*—N. Edwards
(74) *Attorney, Agent, or Firm*—Jane O. Hamby

(57) ABSTRACT

This invention provides polymer filaments having a multilobal cross-section. The cross-section can have a filament factor of about 2.0 or greater and a tip ratio of greater than about 0.2. The filaments may be used as-spun as a spin-oriented feed yarn or as a direct use yarn. The multifilament yarns made from these filaments are useful to make articles with subdued luster and low glitter.

12 Claims, 20 Drawing Sheets

MULTILOBAL POLYMER FILAMENTS AND ARTICLES PRODUCED THEREFROM

CROSS-REFERENCE TO RELATED APPLICATION

This application claims benefit of priority from Provisional Application No. 60/206,980 filed May 25, 2000.

FIELD OF THE INVENTION

This invention provides synthetic polymer filaments having multilobal cross-sections. The filaments may be used in their as-spun form, for example, in yarns resulting from high speed spin-orientation or coupled spin-drawing processes, or may be used as feed yarns for de-coupled drawing or draw texturing processes. The multifilament yarns made from these filaments are useful to make articles with subdued luster and low glitter.

BACKGROUND OF THE INVENTION

There is a desire to provide textured multifilament yarns capable of being converted into knitted or woven fabrics having no undesired glitter. Draw false twist texturing is a method for producing textured multifilament yarns by simultaneously drawing and false-twist texturing undrawn multifilaments. Draw false twist texturing of filaments eliminates the undesirable slickness of fabrics made from synthetic filaments as well as provides filaments with bulk, which provides better cover. However, false twist texturing and draw false twist texturing of filaments having round cross-sections deform the cross-sections of the filaments to a multi-faceted shape having essentially flat sides. As a result, fabrics made from these textured filaments exhibit a specular reflection from the flattened fiber surfaces creating an undesired glittering or sparkle. In addition, the denier per filament (dpf) may be reduced, for example, to improve the softness of the yarns, fabrics and articles produced therefrom, to less than about 5 dpf, or even to deniers below about 1. Such subdenier filaments are also known as "microfibers". At these subdeniers, the total amount of this specular reflection is dramatically increased, due to the increase in total fiber surface area.

Efforts to eliminate the glitter and sparkle associated with filaments having a round cross-section has led to the development of various multilobal cross-sections. For example, U.S. Pat. Nos. 5,108,838, 5,176,926, and 5,208,106 describe hollow trilobal and tetralobal cross-sections to increase the cover to minimize the weight of fiber needed to spread over an area. These patents relate specifically to carpet yarns and higher denier filaments, and not to filaments suited for apparel or twist texturing.

Other modified cross-sections have also been attempted to reduce the glitter from round cross-sectional filaments. For example, U.S. Pat. No. 4,041,689 relates to filaments having a multilobal cross-section. Moreover, U.S. Pat. No. 3,691,749 describes yarns made from multilobal filaments prepared from PACM polyamide. However, the filaments described in these patents still need to be textured prior to use and do not provide a means to reduce glitter of fine denier and especially subdenier filaments, yarns, fabrics and articles produced therefrom.

Other efforts to reduce glitter include the use of polymer additives. For example, delustrants, such as titanium dioxide, have been used to decrease the glittering effect from textured yarns. However, such delustrants alone have been ineffective in reducing the glitter of fibers having fine deniers.

Various fiber and fabric treatments have been proposed that effect glitter including caustic treatments. However, such caustic approaches have inherent disadvantages such as added costs and/or increased waste by-products.

The use of multicomponent fibers to reduce the glitter effect has also been attempted. For example, U.S. Pat. No. 3,994,122 describes a mixed yarn comprising 40–60% by weight of trilobal filaments having a modification ratio within the range of 1.6–1.9, and 40–60% by weight of trilobal filaments having a modification ratio within the range of 2.2–2.5. In addition, U.S. Pat. No. 5,948,528 describes obtaining a filament having modified cross-sections for bicomponent fibers, wherein the fibers are composed of at least two polymer components having different relative viscosities. While yarns made from such multicomponent filaments have a bulking effect that does not necessarily require additional texturing, the production of these fibers are encumbered by the necessity to use a mixture of two or more different polymers or fibers.

Accordingly, there is a need to obtain a filament that can be used to make yarns, and articles therefrom, such as fabrics and apparel, having reduced glitter and shine without the necessity for high levels of added delustrants or fabric after-treatments, and that provide the desirable low glitter and shine without the need for additional texturing. Additionally, there is a need, that, if desired, the filaments can be textured, including by false-twist texturing or by draw false-twist texturing, and still provide the desirable low glitter and low shine to the yarns, fabrics and articles produced therefrom. There is additionally a need to obtain a low denier filament, preferably a filament that can be drawn to a subdenier filament, and especially preferred a filament that is subdenier as-produced, that provides low glitter and shine to the fine denier yarns, fabrics and articles produced therefrom. These low denier and subdenier filaments should have sufficient tensile properties to enable the filaments to be subsequently processed, with low levels of broken filaments, into fabrics and articles therefrom.

SUMMARY OF THE INVENTION

In accordance with these needs, the present invention provide a synthetic filament having a multilobal cross-section, a filament factor of about 2 or greater, wherein the filament factor is determined according to the following formula:

$$FF=K_1*(MR)^A*(N)^B*(1/(DPF)^C[K_2*(N)^D*(MR)^E*1/(LAF)+K_3*(AF)],$$

wherein $K_1$ is 0.0013158; $K_2$ is 2.1; $K_3$ is 0.45; A is 1.5; B is 2.7; C is 0.35; D is 1.4; E is 1.3; MR is $R/r_1$, wherein R is the radius of a circle centered in the middle of the cross-section and circumscribed about the tips of the lobes, and $r_1$ is the radius of circle centered in the middle of the cross-section and inscribed within the cross-section about the connecting points of the lobes; N is the number of lobes in the cross-section; DPF is the denier per filament; LAF is $(TR)*(DPF)*(MR)^2$, wherein TR is $r_2/R$, wherein $r_2$ is the average radius of a circle inscribed about the lobes, and R is as set forth above, and DPF and MR are as set forth above; and AF is 15 minus the lobe angle, wherein the lobe angle is the average angle of two tangent lines laid at the point of inflection of curvature on each side of the lobes of the filament cross-section, and an average tip ratio of ≧ about 0.2.

In another embodiment of the invention, a filament having a multilobal cross-section, wherein the lobe angle is ≦ about 15° and a denier of less than about 5 dpf is disclosed.

The present invention is further directed to multifilament yarns formed at least in part from the filaments of the present invention, and fabrics and articles formed from such yarns.

In another aspect of the invention, a spinneret capillary correlating to a multilobal cross-section with a filament factor of about 2.0 or greater and a tip ratio of greater than about 0.2 is disclosed.

In yet another aspect of the invention, there is provided a process for making a filament having a multilobal cross-section, wherein the filament cross-section has a filament factor of ≧ about 2.0 and a tip ratio of ≧ about 0.2, said process comprising melting a melt-spinnable polymer to form a molten polymer; extruding the molten polymer through a spinneret capillary designed to provide a cross-section having a filament factor of ≧ about 2.0 and a tip ratio ≧ of 0.2; quenching the filaments leaving the capillary; converging the quenched filaments; and winding the filaments.

The present invention is further directed to a method for reducing glitter in fabric comprising forming said fabric using at least one filament having a multilobal cross-section, a filament factor of about 2 or greater, and a tip ratio of ≧ about 0.2.

BRIEF DESCRIPTION OF THE DRAWINGS

FIG. 2 is a cross-section of trilobal filaments of the present invention.

FIG. 3 is a cross-section of hexalobal filaments of the present invention.

FIG. 4 is a cross-section of hexalobal filaments of the present invention.

FIG. 5 is a cross-section of hexalobal filaments of the present invention.

FIG. 7 is a cross-section of hexalobal filaments of the present invention.

FIG. 10 is a comparative cross-section of octalobal filaments of a commercially available product.

DETAILED DESCRIPTION OF THE PREFERRED EMBODIMENTS OF THE INVENTION

Figure 12:
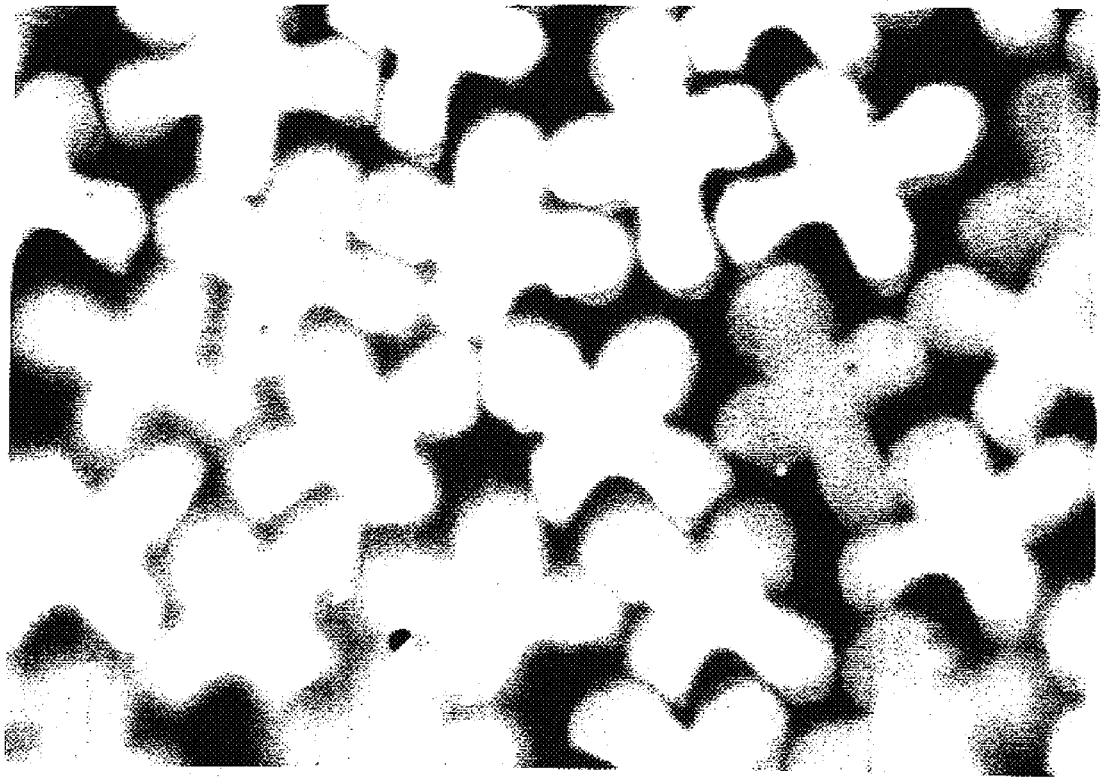
FIG. 12 is a cross-section of 4-lobed filaments of the present invention that are asymmetrical. The shortest lobe had a FF of 5.27 and the longest lobe had a FF of 8.83. The filaments have an average DPF of 1.28 and negative lobe angle.

The filaments of the present invention have a multilobal cross-section. A preferred multilobal includes a cross-section having an axial core with at least three lobes of about the same size. Preferably, the number of lobes is between 3 to 10 lobes, most preferably between 3 to 8 lobes, for example, having 3, 4, 5, 6, 7, or 8 lobes. The lobes of the cross-section may be symmetrical or asymmetrical. The lobes may be essentially symmetrical having substantially equal lengths and equispaced radially about the center of the filament cross-section. Alternatively, the lobes may have different lengths about the center of the filament cross-section, but where the cross-section is still symmetrical, i.e., having two sides being essentially mirror images of each other. For example, FIG. 12 shows a cross-section of the present invention having four lobes, wherein the lobes have different lengths, but the lobes are arranged symmetrically around the core. In yet another embodiment, the lobes may be asymmetrical having different lengths about the center of the filament cross-section and the cross-section may be asymmetrical.

The core and/or lobes of the multilobal cross-section of the present invention may be solid or include hollows or voids. Preferably, the core and lobes are both solid. Moreover, the core and/or lobes may have any shape provided that the tip ratio is ≧ about 0.2, preferably ≧ about 0.3, most preferably ≧ about 0.4, and either the filament factor is ≧ about 2 or the lobe angle is ≦ 15°, as described. Preferably, the core is circular and the lobes are rounded and connected to the core, wherein adjacent lobes are connected to one another at the core. Most preferably, the lobes are rounded, for example, as shown in FIG. 1.

Figure 1:
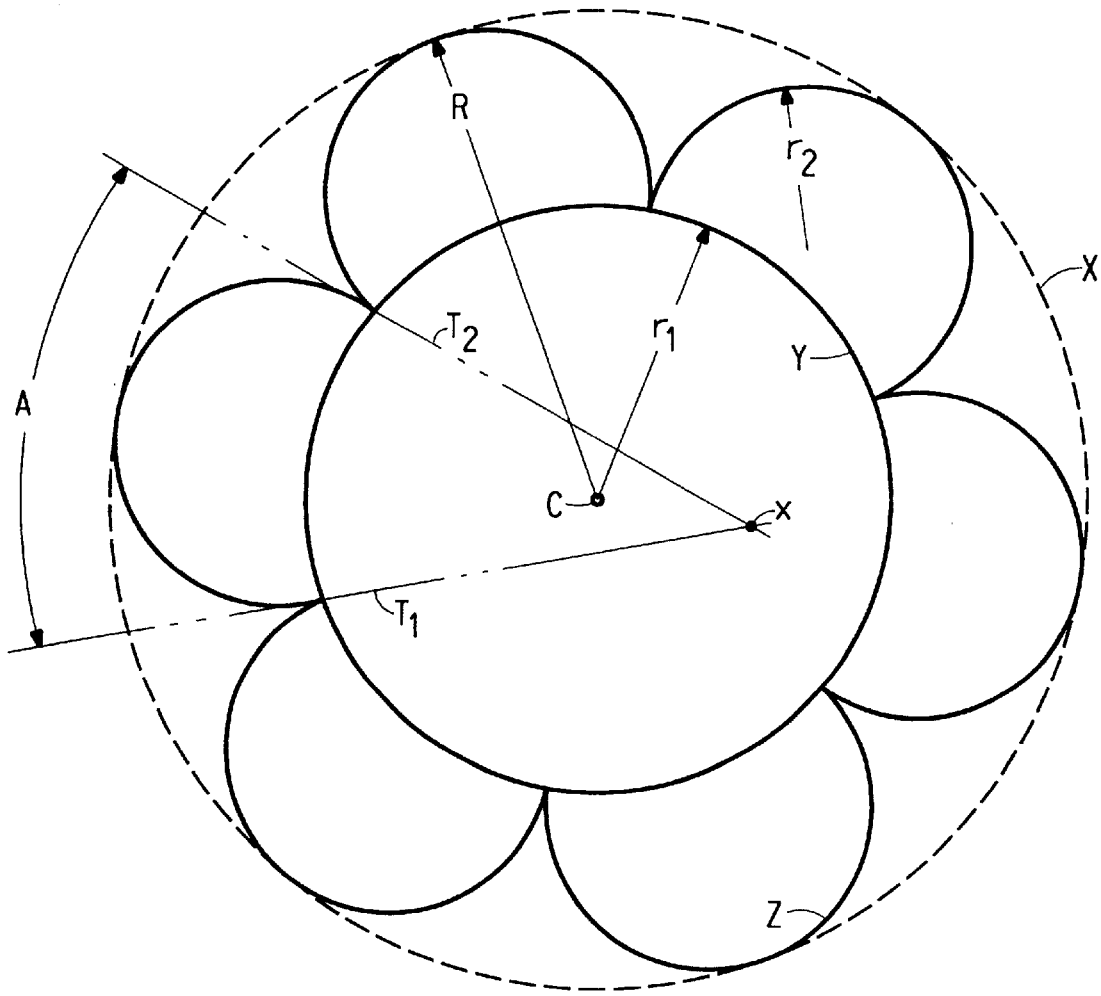
FIG. 1 represents an illustration of how the modification ratio, lobe angles, and filament factors may be determined based upon measurements of the filament cross-sections.

The term "essentially symmetric lobes" means that a line joining the lobe tip to center C will bisect the lobe area located above (outside of) circle Y, as shown in FIG. 1, into two approximately equal areas, which are essentially mirror images of one another.

By "lobes equispaced radially" is meant that the angle between a line joining any lobe tip to center C, as shown in FIG. 1, and the line joining the tip of the adjacent lobe is about the same for all adjacent lobes.

The term "equal length" when applied to lobes means that in a cross-sectional photomicrograph, a circle can be constructed, which passes the margins of each of the tips of the lobes tangentially. Small variations from perfect symmetry generally occur in any spinning process due to such factors as non-uniform quenching or imperfect spinning orifices. It is to be understood that such variations are permissible provided that they are not of a sufficient extent to cause glitter in fabrics after texturing.

The tip ratio (TR) is calculated according to the following formula: $TR=r_2/R$, where $r_2$ is the average radius of the lobes and R is the radius of circle X centered at C and circumscribed about the tips of the lobes Z. When all the lobes have essentially the same radius $r_2$, the tip ratio is essentially the same for each lobe. However, the lobes may have different lengths $r_2$ relative to each other for both symmetrical and asymmetrical cross-sections of the present invention. For example, a cross-section of the present invention may include four lobes, wherein two lobes have one length and the other two lobes have a different length, but where the two sides of the cross-section are symmetrical. Alternatively, the lobes may have different lengths $r_2$, wherein the two sides of the cross-section are asymmetrical. Moreover, it is noted that the radius R may be different for lobes having different lengths because R is based on a circle X circumscribing the tips of the lobes. For both symmetrical and asymmetrical lobes, the tip ratio for each lobe is calculated based on the particular $r_2$ length of the lobe and the radius R of the circle X circumscribing each lobe. Then, an average of the tip ratios for each of the lobes is calculated. As used herein, the "tip ratio" refers to the average tip ratios for a cross-section unless otherwise specified. Any suitable tip ratio may be used provided that either the filament factor is ≧ about 2 or the denier per filament (dpf) is ≦ about 5. Preferably, the tip ratio is ≧ about 0.2, more preferably, ≧ about 0.3, and most preferably ≧ about 0.4. Also, when the lobes are asymmetrical the lobes may differ in other geometric parameters such as lobe angle or modification ratio, or in combinations of differing geometric properties such as modification ratio and lobe angle, as long as the average filament factor for the filament is at least 2.0.

The lobe angle of the lobes of the filament cross-section is the angle of two tangent lines laid at the point of inflection of curvature on each side of the lobe and may be either negative, positive, or zero. Referring to FIG. 1, the lobe angle, A, is considered to be negative when the two tangent lines $T_1$ and $T_2$ converge at a point X inside of the cross-section or exterior to the cross-section on the side opposite to the lobe. Conversely, a lobe angle is positive when the two tangent lines converge at a point exterior to the cross-section on the same side of the lobe (not shown). As used herein, the "lobe angle" of the cross-section is the average lobe angle unless otherwise specified. The cross-section of the filaments of the present invention can have any lobe angle. In one preferred embodiment, the lobe angle is ≦15°, more preferably, ≦0°, and even most preferably, ≦−30°. Negative lobe angles are especially preferred in the filaments of the present invention.

The geometric cross-sections of filaments of the present invention may further be analyzed according to other objective geometric parameters. For example, the filament factor (FF) is calculated according to the following equation:

$$FF=K_1*(MR)^A*(N)^B*(1/(DPF)^C[K_2*(N)^D*(MR)^E*(1/(LAF))+K_3*(AF)],$$

wherein, referring to FIG. 1, modification ratio $(MR)=R/r_1$; tip ratio $(TR)=r_2/R$; N is the number of lobes in the cross-section, DPF is the denier per filament, lobe angle is as described above, angle factor (AF)=(15−Lobe Angle), and lobe area factor $(LAF)=(TR)*(DPF)*(MR)^2$. $K_1$ is 0.0013158, $K_2$=2.1, $K_3$=0.45, A=1.5, B=2.7, C=0.35, D=1.4, and E=1.3. R is the radius of circle X centered at C and circumscribed about the tips of the lobes Z. $r_1$ is the radius of circle Y centered at C and inscribed within the cross-section. $r_2$ is the average radius of the lobes. As used herein, the "filament factor" of the cross-section is the average filament factor for the cross-section. It has been generally found that the greater the filament factor, the less glitter. Preferably, the filaments of the present invention have a filament factor ≧2.0, more preferably, the filament factors is ≧3.0, and most preferably, the filament factor is ≧4.0.

The filaments of the present invention may be made of homopolymers, copolymers, terpolymers, and blends of any synthetic, thermoplastic polymers, which are melt-spinnable. Melt-spinnable polymers include polyesters, such as polyethylene terephthalate ("2-GT"), polytrimethylene terephthalate or polypropylene terephthalate ("3-GT"), polybutylene terephthalate ("4-GT"), and polyethylene naphthalate, poly(cyclohexylenedimethylene), terephthalate, poly(lactide), poly[ethylene(2,7-naphthalate)], poly(glycolic acid), poly(.alpha.,.alpha.-dimethylpropiolactone), poly(para-hydroxybenzoate) (akono), poly(ethylene oxybenzoate), poly(ethylene isophthalate), poly(hexamethylene terephthalate), poly (decamethylene terephthalate), poly(1,4-cyclohexane dimethylene terephthalate) (trans), poly(ethylene 1,5-naphthalate), poly(ethylene 2,6-naphthalate), poly(1,4-cyclohexylidene dimethylene terephthalate)(cis), and poly (1,4-cyclohexylidene dimethylene terephthalate)(trans); polyamides, such as polyhexamethylene adipamide (nylon 6,6); polycaprolactam (nylon 6); polyenanthamide (nylon 7); nylon 10; polydodecanolactam (nylon 12); polytetramethyleneadipamide (nylon 4,6); polyhexamethylene sebacamide (nylon 6,10); the polyamide of n-dodecanedioic acid and hexamethylenediamine (nylon 6,12); the polyamide of dodecamethylenediamine and n-dodecanedioic acid (nylon 12,12), PACM-12 polyamide derived from bis(4-aminocyclohexyl)methane and dodecanedioic acid, the copolyamide of 30% hexamethylene diammonium isophthalate and 70% hexamethylene diammonium adipate, the copolyamide of up to 30% bis-(P-amidocyclohexyl) methylene, and terephthalic acid and caprolactam, poly(4-aminobutyric acid) (nylon 4), poly(8-aminooctanoic acid) (nylon 8), poly(hapta-methylene pimelamide) (nylon 7,7), poly(octamethylene suberamide) (nylon 8,8), poly (nonamethylene azelamide) (nylon 9,9), poly (decamethylene azelamide) (nylon 10,9), poly (decamethylene sebacamide (nylon 10,10), poly[bis(4-amino-cyclohexyl)methane-1,10-decanedicarboxamide], poly(m-xylene adipamide), poly(p-xylene sebacamide), poly(2,2,2-trimethylhexamethylene pimelamide), poly (piperazine sebacamide), poly(meta-phenylene isophthalamide) poly(p-phenylene terephthalamide), poly (11-amino-undecanoic acid) (nylon 11), poly(12-aminododecanoic acid) (nylon 12), polyhexamethylene isophthalamide, polyhexamethylene terephthalamide, poly (9-aminononanoic acid) (nylon 9); polyolefins, such as polypropylene, polyethylene, polymethypentene, and polyurethanes; and combinations thereof. Methods of making the homopolymers, copolymers, terpolymers and melt blends of such polymers used in the present invention are known in the art and may include the use of catalysts, co-catalysts, and chain-branchers to form the copolymers and terpolymers, as known in the art. For example, a suitable polyester may contain in the range of about 1 to about 3 mole % of ethylene-M-sulfo-isophthalate structural units, wherein M is an alkali metal cation, as described in U.S. Pat. No. 5,288,553, or 0.5 to 5 mole % of lithium salt of glycollate of 5-sulfo-isophthalic acid as described in U.S. Pat. No. 5,607,765. Preferably, the polymer is a polyester and/or polyamide, and most preferably, polyester.

Filaments of the invention can also be formed from any two polymers as described above into so-called "bicomponent" filaments, including bicomponent polyesters prepared from 2-GT and 3-GT. The filaments can comprise bicomponent filaments of a first component selected from polyesters, polyamides, polyolefins, and copolymers thereof and a second component selected from polyesters, polyamides, polyolefins, natural fibers, and copolymers thereof, the two components being present in a weight ratio of about 95:5 to about 5:95, preferably about 70:30 to about 30:70. In a preferred bicomponent embodiment, the first component is selected from poly(ethylene terephthalate) and copolymers thereof and the second component is selected from poly(trimethylene terephthalate) and copolymers thereof. The cross-section of the bicomponent fibers can be side-by-side or eccentric sheath/core. When a copolymer of poly(ethylene terephthalate) or poly(trimethylene terephthalate) is used, the comonomer can be selected from linear, cyclic, and branched aliphatic dicarboxylic acids having 4–12 carbon atoms (for example, butanedioic acid, pentanedioic acid, hexanedioic acid, dodecanedioic acid, and 1,4-cyclo-hexanedicarboxylic acid); aromatic dicarboxylic acids other than terephthalic acid and having 8–12 carbon atoms (for example, isophthalic acid and 2,6-naphthalenedicarboxylic acid); linear, cyclic, and branched aliphatic diols having 3–8 carbon atoms (for example, 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and araliphatic ether glycols having 4–10 carbon atoms (for example, hydroquinone bis(2-hydroxyethyl) ether, or a poly(ethyleneether)glycol having a molecular weight below about 460, including diethyleneether glycol). Isophthalic acid, pentanedioic acid, hexanedioic acid, 1,3-propane diol, and 1,4-butanediol are preferred because they are readily commercially available and inexpensive. Isophthalic acid is more preferred because copolyesters derived from it discolor less than copolyesters made with some other comonomers. When a copolymer of poly(trimethylene terephthalate) is used, the comonomer is preferably isophthalic acid. 5-sodium-sulfoisophthalate can be used in minor amounts as a dyesite comonomer in either polyester component.

Also, a yarn or fabric formed at least in part from a filament having the cross-section of the present invention may also include other thermoplastic melt spinnable polymers or natural fibers, such as cotton, wool, silk, or rayon in any amounts. For example, a natural fiber and polyester filament of the present invention in an amount of about 75% to about 25% of the natural fiber and 25% to about 75% of the polyester filament of the present invention.

It will be understood by one skilled in the art that filaments of identical configuration but prepared from different synthetic polymers or from polymers having different crystalline or void contents can be expected to exhibit different glitter. Nevertheless, it is believed that improved glitter will be achieved with any synthetic polymeric filament of the now-specified configuration regardless of the particular polymer selected.

The polymers and resultant fibers used in the present invention can comprise conventional additives, which are added during the polymerization process or to the formed polymer, and may contribute towards improving the polymer or fiber properties. Examples of these additives include antistatics, antioxidants, antimicrobials, flameproofing agents, dyestuffs, pigments, light stabilizers, such as ultraviolet stabilizers, polymerization catalysts and auxiliaries, adhesion promoters, delustrants, such as titanium dioxide, matting agents, organic phosphates, additives to promote increased spinning speeds, and combinations thereof. Other additives that may be applied on fibers, for example, during spinning and/or drawing processes include antistatics, slickening agents, adhesion promoters, antioxidants, antimicrobials, flameproofing agents, lubricants, and combinations thereof. Moreover, such additional additives may be added during various steps of the process as is known in the art. In a preferred embodiment, delustrants are added to the filaments of the present invention in an amount of 0%, more preferably, less than 0.4%, and most preferably, less than 0.2% by weight. If a delustrant is added, preferably it is titanium dioxide.

The filaments of the present invention are formed by any suitable spinning method and may vary based upon the type of polymer used, as is known in the art. Generally, the melt-spinnable polymer is melted and the molten polymer is extruded through a spinneret capillary orifice having a design corresponding to the desired lobe angle, number of lobes, modification ratio, and filament factor desired, according to the present invention. The extruded fibers are then quenched or solidified with a suitable medium, such as air, to remove the heat from the fibers leaving the capillary orifice. Any suitable quenching method may be used, such as cross-flow, radial, and pneumatic quenching.

Cross-flow quench, as disclosed, e.g., in U.S. Pat. Nos. 4,041,689, 4,529,368, and 5,288,553, involves blowing cooling gas transversely across and from one side of the freshly extruded filamentary array. Much of this cross-flow air passes through and out the other side of the filament array. "Radial quench", as disclosed, e.g., in U.S. Pat. Nos. 4,156,071, 5,250,245, and 5,288,553, involves directing cooling gas inwards through a quench screen system that surrounds the freshly extruded filamentary array. Such cooling gas normally leaves the quenching system by passing down with the filaments, out of the quenching apparatus. The type of quench may be selected or modified according to the desired application of the filaments and the type of polymers used. For example, a delay or anneal zone may be incorporated into the quenching system as in known in the art. Moreover, higher denier filaments may require a quenching method different from lower denier filaments. For example, laminar cross-flow quenching with a tubular delay has particularly been found useful for fine filaments having $\leqq 1$ dpf. Also, radially quenching has been found preferred for fine filaments below 1 dpf.

Pneumatic quenching and gas management quenching techniques have been discussed, for example, in U.S. Pat. Nos. 4,687,610, 4,691,003, 5,141,700, 5,034,182, and 5,824,248. These patents describe processes whereby gas surrounds freshly extruded filaments to control their temperature and attenuation profiles.

Figure 1A:
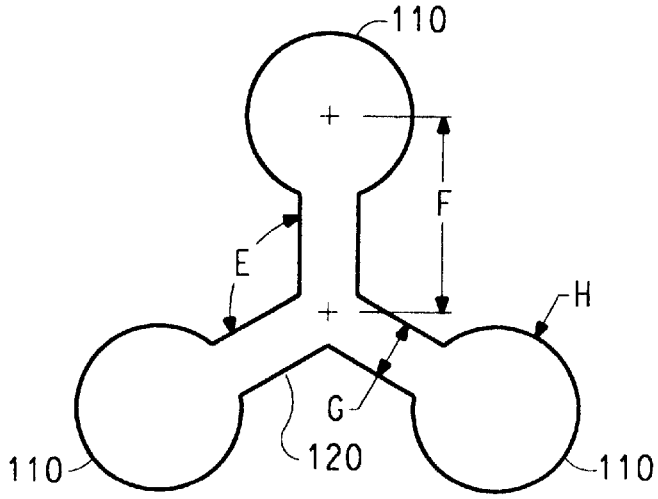
FIG. 1A is one embodiment of a spinneret capillary that may be used to produce filaments having a 3-lobed cross-section of the present invention.
Figure 1B:
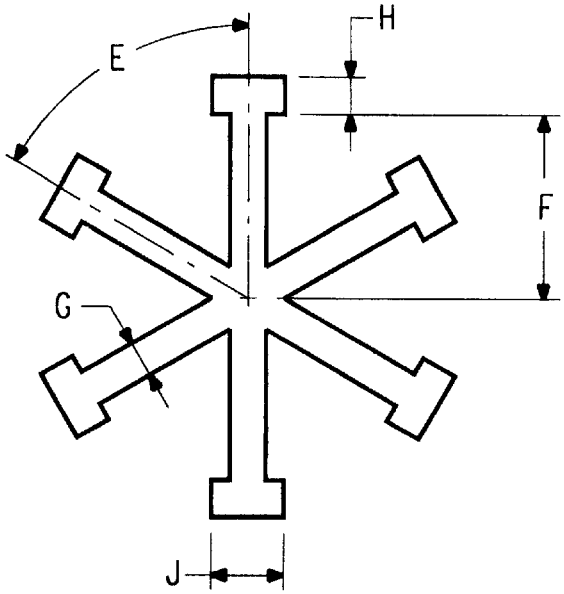
FIG. 1B is another embodiment of a spinneret capillary that may be used to produce filaments having a 6-lobed cross-section of the present invention.
Figure 1C:
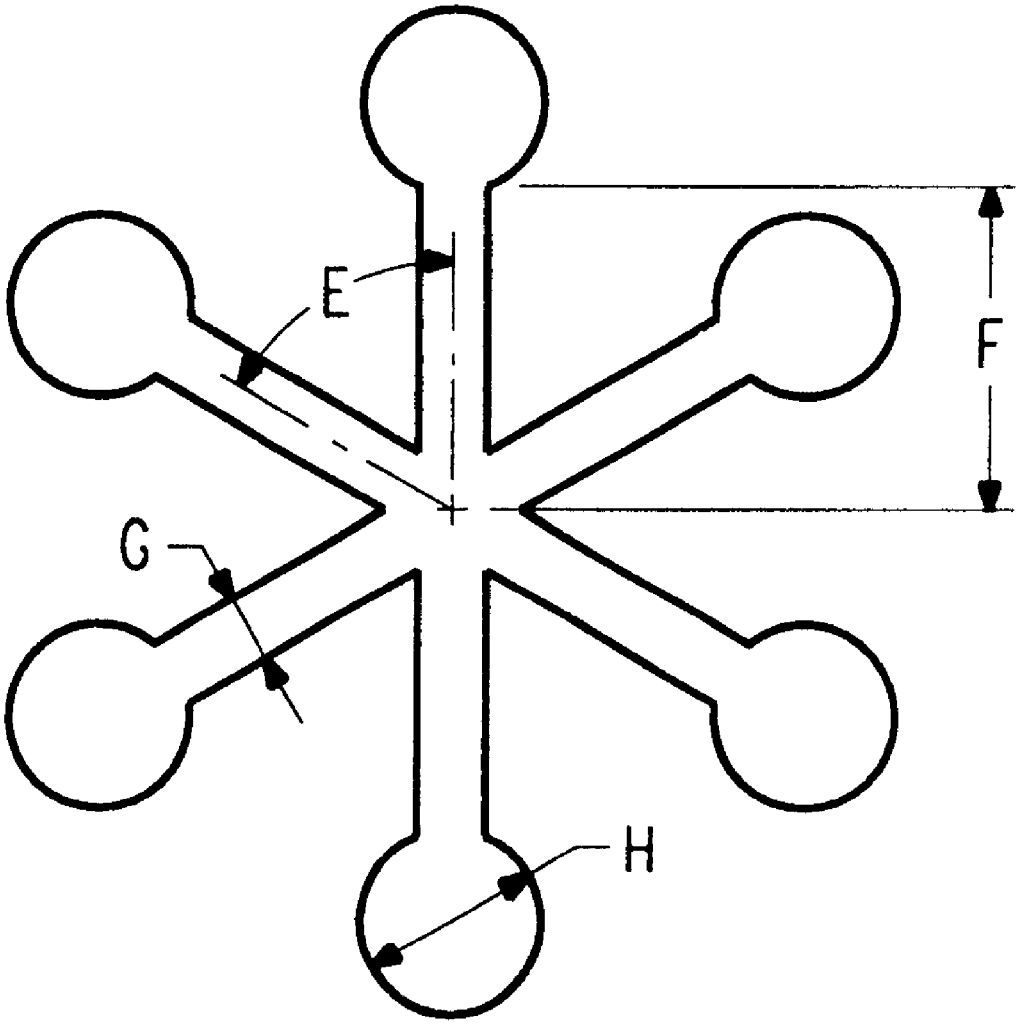
FIG. 1C is another embodiment of a spinneret capillary that may be used to produce filaments having a 6-lobed cross-section of the present invention.

The spinneret capillaries through which the molten polymer is extruded are cut to produce the desired cross-section of the present invention, as described above. For example, the capillaries are designed to provide a filament having a filament factor of at least 2.0, preferably $\geqq 3.0$, and most preferably $\geqq 4.0$. This may be done, for example, by modifying the capillary to give a filament having a desired modification ratio, number of lobes, and lobe angle. Furthermore, the capillaries may further be designed to provide filaments having any lobe angle provided that the filament factor is ≧2.0. For example, the capillaries may be designed to provide filaments that have a lobe angle of ≦15°, preferably ≦0°, and most preferably ≦−30°. The capillaries or spinneret bore holes may be cut by any suitable method, such as by laser cutting, as described in U.S. Pat. No. 5,168,143, herein incorporated by reference, drilling, Electric Discharge Machining (EDM), and punching, as is known in the art. Preferably, the capillary orifice is cut using a laser beam. The orifices of the spinneret capillary can have any suitable dimensions and may be cut to be continuous or non-continuous. A non-continuous capillary may be obtained by boring small holes in a pattern that would allow the polymer to coalesce and form the multilobal cross-section of the present invention. Examples of spinneret capillaries suitable for producing filaments of the invention are shown in FIGS. 1A, 1B, 1C. FIG. 1A depicts a spinneret capillary having three slots 110 centrally-joined at a core 120 and projecting radially. The angle (E) between the slot center lines can be any suitable angle and the slot width (G) can have any suitable dimension. Furthermore, the end of the slots (H) may have any desired shape or dimension. For example, FIGS. 1A and 1C show circular enlargement (H) at the end of the slots, while FIG. 1B shows a rectangular opening having a width (J) and length (H) at the end of the slot. The length of the slots (F) can further be any desired length. The spinneret capillaries of FIGS. 1A, 1B, and 1C may be modified to achieve different multilobal filaments having FF of at least 2.0, for example, by changing the number of capillary legs for a different desired lobe count, changing slot dimensions to change the geometric parameters, for production of a different DPF, or as desired for use with various synthetic polymers. For example, in FIG. 1A, the capillary can have an angle (E) of 120°, a slot width (G) of 0.043 mm, a diameter (H) of the circular enlargement at the end of the slot of 0.127 mm, and a slot length (F) of 0.140. In FIG. 1B, the capillary can have an angle (E) of 60°, a slot width (G) of 0.081 mm, a length (H) of the rectangular opening of 0.076 mm, a width (J) of the rectangular opening of 0.203 mm, and a slot length (F) of 0.457 mm. In FIG. 1C, the capillary can have an angle (E) of 60°, a slot width (G) of 0.081 mm, a diameter (H) of the circular openings 0.127 mm, and a slot length (F) of 0.457 mm. A metering capillary may be used upstream of the shaping orifice, for example, to increase the total capillary pressure drop. The spinneret capillary plate can have any desired height, such as, for example, 0.254 mm.

After quenching, the filaments are converged, interlaced, and wound as a multifilament bundle. Filaments of the invention, if sufficiently spin-oriented, can be used directly in fabric production. Alternatively, filaments of the invention can be drawn and/or heat set, e.g., to increase their orientation and/or crystallinity. Drawing and/or heat setting can be included in the drawing or texturing processes, for example, by draw warping, draw false-twist texturing or draw air-jet texturing the filaments and yarns of the invention. Texturing processes known in the art, such as air-jet texturing, false-twist texturing, and stuffer-box texturing, can be used. The multifilament bundles can be converted into fabrics using known methods such as weaving, weft knitting, or warp knitting. Filaments of the invention can alternatively be processed into nonwoven fibrous sheet structures. Fabrics produced using the as-spun, drawn, or textured filaments of the invention can be used to produce articles such as apparel and upholstery.

The filaments of the invention, whether in as-spun form or textured form, provide advantages to the multifilament bundles, fabrics and articles produced therefrom, such as a pleasing fabric luster essentially free of objectionable glitter. The highly-shaped filaments of the invention, even in very fine deniers including subdeniers, can be produced with tensile properties sufficient to withstand demanding textile processes such as draw false-twist texturing with low levels of broken filaments. The fine and subdenier filaments of the invention, in either as-spun or textured form, can be used to provide fabrics and articles therefrom having properties such as moisture transport that are especially advantageous to performance apparel applications. Accordingly, in one preferred embodiment, the filaments are spun as a direct-use yarn, which may be immediately used in manufacturing articles. Furthermore, as a result of the ability to use the present process to produce direct-use yarns via high speed spinning, it has been found that the process of the present invention is capable of generating an increased spinning productivity.

Optionally, however, the filaments of the present invention may be textured, also known as "bulked" or "crimped," according to known methods. In one embodiment of the invention, the filaments may be spun as a partially oriented yarn and then textured by techniques, such as by draw false-twist texturing, air-jet texturing, gear-crimping, and the like.

Any false-twist texturing process may be used. For example, a continuous false-twisting process may be conducted, wherein a substantial twist is applied to the yarn by passing it through a rotating spindle or other twist-imparting device. As the yarn approaches the twist-imparting device, it accumulates a high degree of twist. Then, while the yarn is in a high degree of twist, it is passed through a heating zone and a permanent helical twist configuration is set in the yarn. As the yarn emerges from the twist-imparting device, the torsional restraint on the forward end of the yarn is released and the yarn tends to resume its twisted configuration, thereby promoting the formation of helical coils or crimps. The degree of crimping is dependent upon factors such as the torsion applied, amount of heat applied, frictional qualities of the twist-imparting device, and turns per inch of twist applied to the yarn.

An alternative draw-texturing process includes the simultaneous drawing and texturing of a partially oriented yarn as is known in the art. In one such process, the partially oriented yarn is passed through a nip roll or feed roll and then over a hot plate (or through a heater), where it is drawn while in a twisted configuration. The filaments in the yarn then pass from the hot plate (heater) through a cooling zone and to a spindle or twist-imparting device. As they exit the spindle, the filaments untwist and are passed over a second roller or draw roll. After the yarn exits from the draw roll, the tension is reduced as the yarn may be fed to a second heater and/or wound up.

The filaments of the invention can be processed into a multifilament fiber, yarn or tow having any desired filament count and any desired dpf. Moreover, the dpf may differ between a draw-false-twist textured yarn and a spin-oriented direct use yarn. The drawn or as-spun yarn of the present invention may be used, for example, in apparel fabrics, which can have a dpf of less than about 5.0 dpf, preferably less than about 2.2 dpf. Most preferably, the yarn is formed of filaments of less than about 1.0 dpf. Such subdenier yarns are also known as "microfibers." Typically, the lowest dpf attained is about 0.2. In one embodiment of the invention, the filaments are made up of polyester in which the denier per filament after draw-false-twist texturing is less than about 1 dpf. In another embodiment, the filaments are spin-oriented direct-use polyesters having a denier of about less than about 5.0 dpf, preferably less than about 3.0 dpf, and most preferably less than about 1.0 dpf. Other yarns may be useful in textiles and fabrics, such as in upholstery, garments, lingerie, and hosiery, and may have a dpf of about 0.2 to about 6 dpf, preferably about 0.2 to about 3.0 dpf. Finally, higher denier yarns are also contemplated for uses, for example, in carpets, having a dpf of about 6 to about 25 dpf.

The yarns of the present invention may further be formed from a plurality of different filaments having different dpf ranges. In such case, the yarns should be formed from at least have one filament having the multilobal cross-section of the present invention. Preferably, each filament of a yarn containing a plurality of different filaments, has the same or different dpf, and each dpf is from about 0.2 to about 5.

The synthetic polymer yarns may be used to form fabrics by known means including by weaving, warp knitting, circular knitting, or hosiery knitting, or a continuous filament or a staple product laid into a non-woven fabric.

The yarns formed from the filaments of the present invention have been found to provide fabrics having low glitter and subdued luster or shine. It is believed that the unique cross-section of the filament attributes to the reduced glitter. In particular, it has been found that as the filament factor is increased with cross-sections having low lobe angles, and preferably $\leqq$ about 15°, the glitter effect is dramatically reduced, particularly in fine denier and subdenier filaments. This glitter effect is even more subdued in subdenier filaments with cross-sections having negative lobe angles.

Moreover, it has further been unexpectedly found that yarns having the filaments with filament factor of at least 2, with a low dpf in the fine range and sub-dpf (microfiber) range have a reduced glitter effect The term "glitter" is reflection of light in intense beams from tiny areas of the filament or fabric, contrasting with the general background reflection. Glitter can occur from small flat areas on the fiber surface, which act as mirrors that reflect full spectrum (white) light. The areas are large enough such that the light reflections termed "glitter" are distinct and can be pinpointed by the eye. Glitter can be rated by a number of means such as rating low, medium, or high levels of glitter, or rating in terms of relative glitter. Both as-spun yarns and textured yarns of the present invention had low levels of glitter.

In addition, it has advantageously been found that the filaments of the present invention are able to absorb dyes, such as cationic dyes, and color. As the denier per filament is reduced in conventional filaments, especially to subdeniers, the fabric depth of color is generally reduced due to the increased fiber surface area and shorter within-fiber distances in which light and dye interactions can occur. It was surprisingly found that subdenier filaments of the invention, even though having greatly increased surface area due to the highly shaped filament exteriors, exhibited fabric coloration superior to prior-art multilobal filaments and approaching that of round cross-sections, in either as-spun or draw-textured configurations, as well as enhanced fabric performance such as moisture transport or wicking. The high coloration and wicking are benefits to the filaments of the present invention in addition to the added advantage of low glitter.

Further, the filaments of the present invention have high tensile properties enabling the filaments to be further processed in texturing and/or fabric formation processes with low levels of broken filaments. In particular, the subdenier multifilament bundles of the invention exhibited tenacity and elongation values, in as-spun and after draw false texturing, that were similar to those achieved with round subdenier filaments. This was surprising due to the much more rapid and non-uniform quenching that was expected when spinning highly-shaped subdenier filaments of the present invention.

As a result of the high tensile properties of the filaments of the present invention, the filaments are especially suited to high stress application including draw false-twist texturing, high speed spinning, and spinning of modified polymers. These findings were particularly found for the sub-dpf filaments of the present invention, which, when draw false-twist textured, exhibited high tensile strength and an orientation level similar to that of round sub-dpf filaments, resulting in low levels of broken filaments. Measurements relating to the orientation level of the spin-oriented filaments are tenacity at 7% elongation ($T_7$), as set forth above, and draw tension (DT). The ability to essentially match the orientation level of the prior-art round fine and subdenier filaments was an advantage in enabling similar draw texturing processes to be used for filaments of the invention. The term "textured yarn broken filaments" (herein "TYBF") references "fray count" in number of frays (broken filaments) per unit length. As compared to its round cross-section counterparts, the sub-dpf filaments having the cross-sections of the present invention were capable of being subjected to the same types of texturing processes as round cross-section yarns, without the production of undesired glitter and high levels of broken filaments.

Moreover, the high tensile strength with low glitter of the filaments of the present invention have been found particularly suitable for fabric applications such as performance apparel and bottomweight-end uses such as slacks and suiting materials, and for blending with low-luster spun fibers such as cotton and wool.

For example, it has been found that the yarns of the present invention have increased cover, particularly relative to yarns having round cross-sections. In addition, the increased cover becomes even more dramatic for lesser denier filaments.

The fabrics of the present invention further have higher wicking rates than many other known cross-sections. Wicking refers to the capillary movement of water through or along the fibers. The ability of the fibers to wick, therefore, increases the ability of the fabric to absorb water and move it away from the body. It has been particularly found that the fabrics using microfibers of the present invention have higher wicking rates than fabric of round microfibers of comparable dpf.

The fabrics of the present invention do not require an external additive such as $TiO_2$ or post-treatments such as described in the art to obtain low glitter. The amount of delustrant may be added in an amount of 0%, or less than about 0.1%, less than about 0.2%, or less than about 1% by weight of delustrant. This has been found particularly compelling for subdeniers, which typically require such delustrant additives or post-treatments to minimize glitter. However, these types of treatments may be used, if desired, for any of the fabrics of the present invention.

TEST METHODS

In the following Examples, circular knit fabrics were prepared using the multifilament yarns of the present invention and assessed for parameters such as glitter and shine ratings, fabric cover and color depth. In some examples the fabrics were made from the as-spun yarn. In some examples the fabrics were made after draw false-twist texturing the feed yarn.

Fabrics were dyed to a deep black shade; all fabrics of a given series were dyed using the same procedure. Fabric glitter and shine were observed in bright sunlight viewing conditions. "Shine" is the low angle surface reflection of full spectrum (white) light with no dye value from the surfaces of fibers. "Glitter", on the other hand, is the reflection of light in intense beams from tiny areas of the filament or fabric, contrasting with the general background reflection. Glitter can occur from small flat areas on the fiber surface, which act as mirrors that reflect full spectrum (white) light. The relative glitter and shine ratings of each item were determined using a paired comparison test, in which each fabric sample was rated against every other sample. A rating for each pairing was assigned: 2 when the sample had less glitter (or shine) than the comparison sample, 1 when the sample had equivalent glitter (or shine), 0 when the sample had more glitter (or shine). Then a total rating for each sample was assigned by totaling the ratings of each paired comparison. By this method, the relative glitter, and relative shine of each sample was determined. For example, the highest numerical rating was obtained by the sample having the lowest glitter.

The Covering Power and Color Depth ratings were assessed using the same fabric samples for which glitter was rated, and were rated using diffuse, fluorescent room lighting. A paired comparison test was used. The relative covering power of each item was determined using a paired comparison test, in which each fabric sample was rated against every other sample. A rating for each pairing was assigned: 2 for the sample having the greatest degree of cover over the white grading surface, i.e., the sample allowing the least amount of white grading surface to be visible through the fabric; a rating of 1 for the sample having equivalent covering power, 0 for the sample having lower covering power. Then a total covering power relative rating was determined for each sample.

Likewise, the relative color depth ratings were determined using a paired comparison test in which each fabric sample was rated against every other sample. A rating for each pairing was assigned: 2 for the sample having deepest black coloration, 1 for the sample having equivalent color depth, 0 for the sample having lower depth of color. Then a total rating for each sample was assigned by totaling the ratings of each paired comparison. By this method, the relative color depth of each sample was determined.

Most of the fiber properties of conventional tensile and shrinkage properties were measured conventionally, as described in the art. Relative viscosity is the ratio of the viscosity of a solution of 80 mg of polymer in 10 ml of a solvent to the viscosity of the solvent itself, the solvent used herein for measuring RV being hexafluoroisopropanol containing 100 ppm of sulfuric acid, and the measurements being made at 25° C. This method has particularly been described in U.S. Pat. Nos. 5,104,725 and 5,824,248.

Denier spread (DS) is a measure of the along-end unevenness of a yarn by calculating the variation in mass measured at regular intervals along the yarn. Denier Spread is measured by running yarn through a capacitor slot, which responds to the instantaneous mass in the slot. As described in U.S. Pat. No. 6,090,485, the test sample is electronically divided into eight 30 meter subsections with measurements every 0.5 meter. Differences between the maximum and minimum mass measurements within each of the eight subsections are averaged. DS is recorded as a percentage of this average difference divided by the average mass along the whole 240 meters of the yarn. Testing can be conducted on an ACW 400/DVA (Automatic Cut and Weigh/Denier Variation Accessory) instrument available form Lenzing Technik, Lenzing, Austria, A-4860.

Tenacity is measured on an Instron equipped with two grips, which hold the yarns at the gauge lengths of 10 inches. The yarn is then pulled by the strain rate of 10 inch/minute, the data are recorded by a load cell, and stress-strain curves are obtained.

The elongation-to-break may be measured by pulling to break on an Instron Tester TTB (Instron Engineering Corporation) with a Twister Head made by the Alfred Suter Company and using 1-inch×1-inch flat-faced jaw clamps (Instron Engineering Corporation). Samples typically about 10-inches in length are subjected to two turns of twist per inch at a 60% per minute rate of extension at 65% Relative Humidity and 70° F.

The boil-off shrinkages of the yarn may be measured using any known method. For example, it may be measured by suspending a weight from a length of yarn to produce a 0.1 gram/denier load on the yarn and measuring its length ($L_0$). The weight is then removed and the yarn is immersed in boiling water for 30 minutes. The yarn is then removed, loaded again with the same weight, and its new length recorded ($L_f$). The percent shrinkage (S) is calculated by using the formula:

$$\text{Shrinkage } (\%)=100\ (L_0-L_f)/L_0$$

Draw Tension is used as a measure of orientation, and is a very important requirement especially for texturing feed yarns. Draw tension, in grams, was measured generally as disclosed in U.S. Pat. No. 6,090,485, and at a draw ratio of 1.707x for as-spun yarns having elongations of at least 90% at 185° C. over a heater length of 1 meter at 185 ypm (169.2 mpm). Draw tension may be measured on a DTI 400 Draw Tension Instrument, available from Lenzing Technik.

Broken filaments, especially of textured yarns, may be measured by a commercial Toray Fray Counter (Model DT 104, Toray Industries, Japan) at a linear speed of 700 mpm for 5 minutes i.e., number of frays per 3500 meters, and then the numbers of frays are expressed herein as the number of frays per 1000 meters.

The invention will now be illustrated by the following non-limiting examples. Although the geometric parameters (refer to FIG. 1) were intended to be applied to multilobal filaments, for the purposes of the round comparative examples, the following geometric parameters were assumed: number of lobes=1, modification ratio=1, tip ratio=1, and the lobe angle=−180°.

EXAMPLES

Example I

Figure 2A:
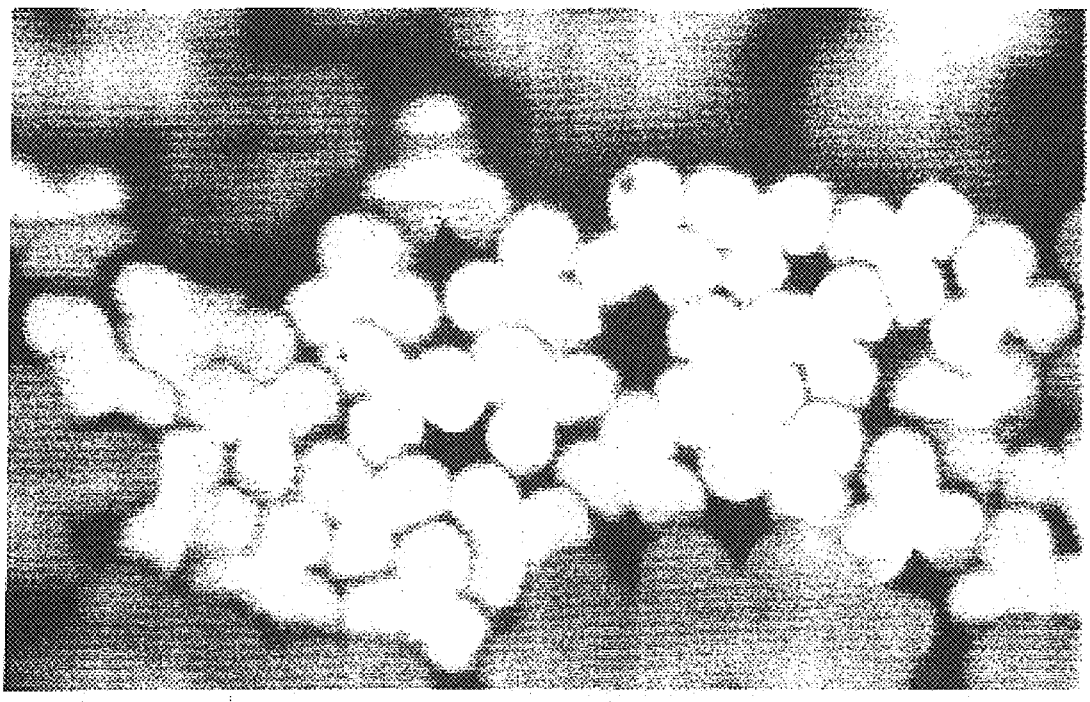
FIG. 2A represents the cross-section of the filaments as-spun, having an average DPF of 0.91, MR of 2.32, TR of 0.45, lobe angle of −54.4 degrees, and FF of 4.1.

Yarns of 100 fine filaments of nominal 1.15 dpf were spun from poly(ethylene terephthalate) of nominal 21.7 LRV (lab relative viscosity) and containing 0.3 weight percent $TiO_2$. The spinning process was essentially as described in U.S. Pat. No. 5,250,245 and U.S. Pat. No. 5,288,553 and using a radial quench apparatus having a delay "shroud" length ($L_{DQ}$) of about 1.7 inches (4.3 cm). Example I-1 yarn was comprised of 3-lobe filaments of the invention having filament cross-sections in appearance similar to FIG. 2A, and was made using 100-capillary spinnerets using 9 mil (0.229 mm) diameter×36 mil (0.914 mm) length metering capillaries and spinneret exit orifices having three slots centrally-joined and projecting radially; slot center lines being separated by 120 degrees (E) as set forth in FIG. 1A. Each slot had the following geometry: 1.7 mil (0.043 mm) slot width (G), having a 5 mil (0.127 mm) diameter circular enlargement (H) at the end of each slot, the center of said circular enlargement being located 5.5 mils (0.140 mm)(F) from the capillary center, said spinneret slots being formed by a method as described in U.S. Pat. No. 5,168,143.

Figure 9:
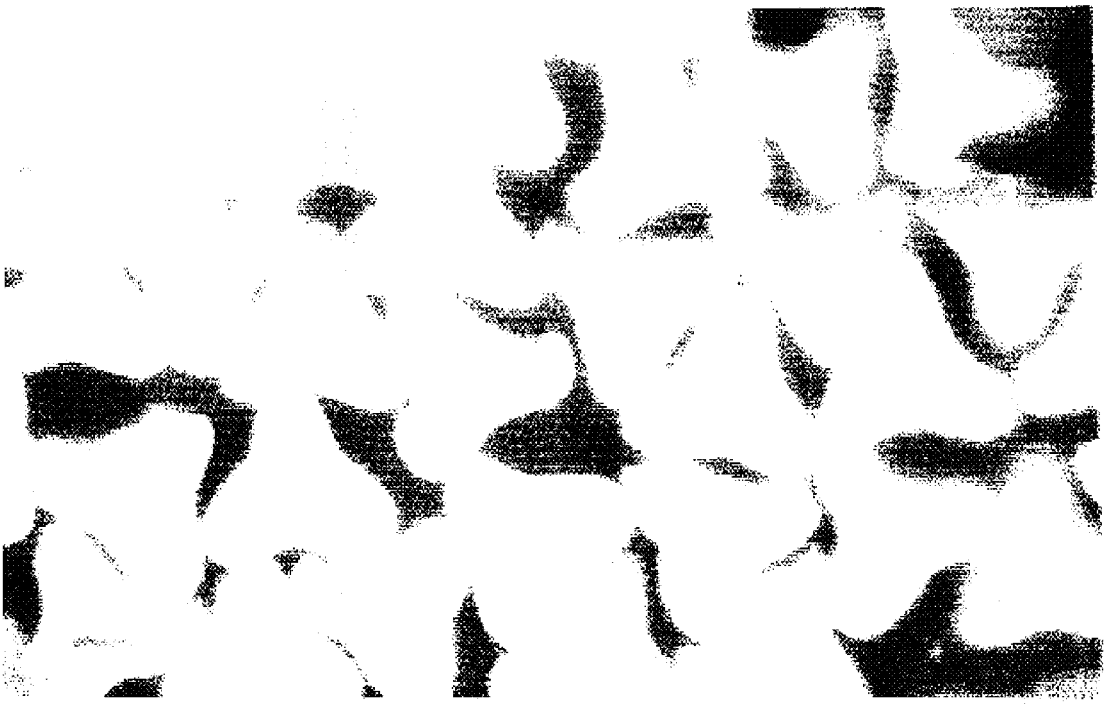
FIG. 9 is a comparative cross-section of a conventional trilobal filament as described in U.S. Pat. No. 2,939,201.

The capillary dimensions used can be adjusted, for example, to produce filaments differing in DPF or in filament geometric parameters, or as desired for a different synthetic polymer. Comparative Example I-A was a trilobal multifilament yarn as disclosed in U.S. Pat. No. 5,288,553 having filament cross-sections in appearance similar to FIG. 9, and was made using spinnerets with 9×36 mil (0.229×0.914 mm) (D×L) metering capillaries and Y-shaped exit orifices having three equally-spaced slots with 5 mil (0.127 mm) slot width and 12 mil (0.305 mm) slot length. Example I-1 and Comparative Example I-A were spun using a spinning speed of 2795 ypm (2556 meters/minute) to obtain partially oriented feed yarns. Comparative Example I-B was a 100-filament yarn having 100 round filaments of nominal 1.15 dpf and produced using 100-capillary spinnerets having round cross-section orifices having 9 mil (0.229 mm) capillary diameter and 36 mil (0.914 mm) capillary depth. Physical properties and cross section parameters of the as-spun examples are given in Table I-1. Draw tension was measured using 1.707 draw ratio, 185° C. heater temperature and 185 ypm (169 meters/minute) feed rate. Example I-1 filaments had average lobe angle of −37.4 degrees and "filament factor" of 2.57, whereas Example I-A filaments had average lobe angle of +19.8 degrees and "filament factor" of 0.84.

Yarns I-1, I-A, and I-B were draw false-twist textured using the same texturing conditions on a Barmag L-900 texturing machine equipped with polyurethane discs and using 1.54 draw ratio, 1.74 D/Y ratio, 180° C. first heater temperature. The draw-textured yarns had a denier per filament (dpf) of approximately 0.76; i.e., the draw-textured filaments were "subdeniers" or "microfibers" by virtue of having denier per filament below 1. Properties of the draw-textured yarns are given in Table I-2. The three-lobe yarn of Example I-1 had lower feed yarn draw tension, and higher tenacity-at-break ($T_B$) and higher elongation in both as-spun and draw-textured forms compared to the trilobal yarn of Example I-A, which was surprising given the more highly-modified cross-sectional shape evidenced by the higher modification ratio and greater lobe wrap angle of the Example I-1 yarn. It had been expected that more highly modified cross sections would result in more highly oriented yarns having higher draw tension and lower elongation in as-spun and draw-textured forms.

Figure 2B:
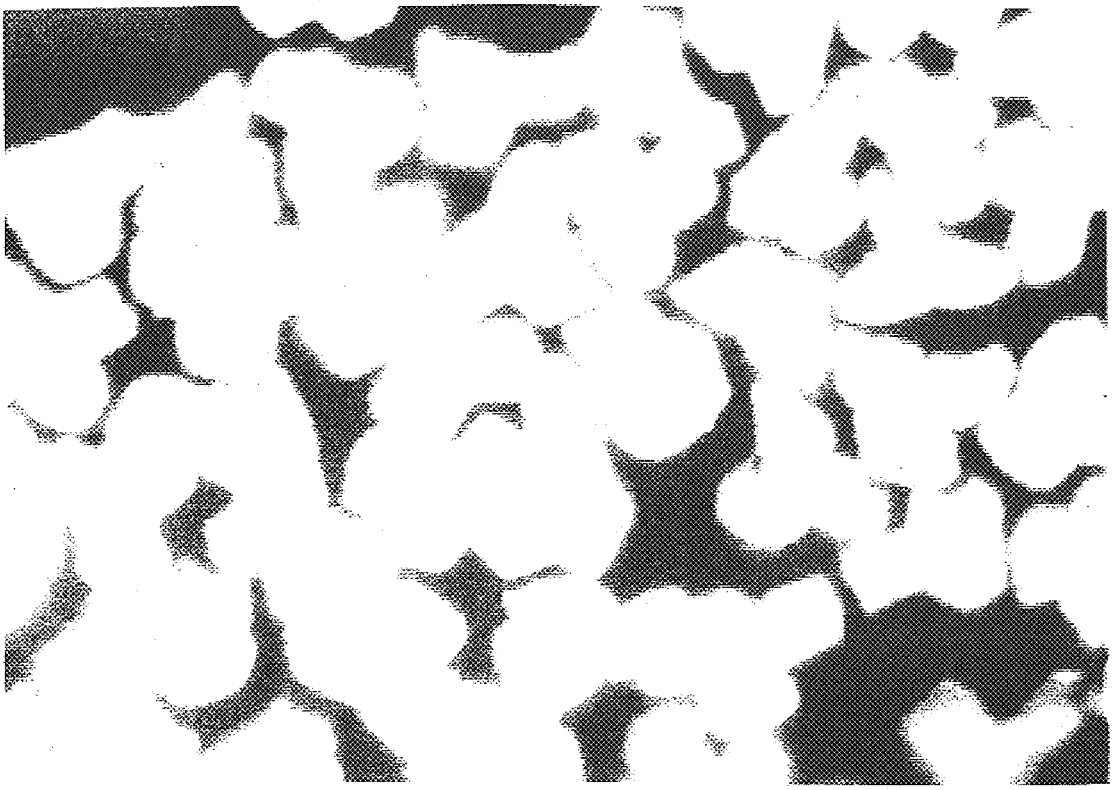
FIG. 2B represents the cross-section of the filaments after draw false-twist texturing at a 1.44 draw ratio.

Black-dyed, circular-knit fabrics were made from each draw-textured yarn I-1, I-A, and I-B using the same fabric construction and dyeing conditions. Fabrics were rated for relative glitter and shine under bright sunlight viewing, and rated for relative covering power under diffuse room lighting. Fabric ratings are shown in Table I-3. The fabric made from Example I-1 yarn comprised of false-twist textured subdenier filaments of three lobes and "filament factor" ≧2 had the lowest glitter and shine (highest numerical ratings) and highest covering power. The draw-textured filaments of Example I-1 had filament cross-sections in appearance similar to FIG. 2B, which exhibited some lobe distortion from the texturing process but retained in general distinctly 3-lobed filaments that provided low fabric glitter.

TABLE I-2

TEXTURED YARN PROPERTIES

| Ex. | Text. Denier | Text. dpf | Text. Tenacity (gpd) | Text. Elo. (%) | Text. Tb (gpd) | Leesona Shrinkage (%) | Fray Count (bf/1000 meters) |
|---|---|---|---|---|---|---|---|
| I-1 | 76 | 0.76 | 4.41 | 39.3 | 6.14 | 13.30 | 1.1 |
| I-A | 78 | 0.78 | 4.50 | 35.2 | 6.09 | 15.20 | 0.0 |
| I-B | 76 | 0.76 | 4.63 | 40.4 | 6.50 | 18.02 | 2.2 |

TABLE I-3

FABRIC RATINGS

| | Fabric Ratings | | |
|---|---|---|---|
| Ex. | Shine Rating | Covering Power | Glitter Rating |
| I-1 | 9 | 7 | 9 |
| I-A | 4 | 6 | 5 |
| I-B | 2.5 | 1 | 1 |

Example II

Yarns comprised of fine filaments of nominal 1.24 dpf and 3-lobe cross-sections were spun at 2675 ypm (2446 meters/minute), essentially as described in Example I-1; 100-filament yarn bundles were combined prior to takeup to produce 200-filament yarn bundles. Example II-1 yarn was comprised of fine multilobal filaments of the invention, having average filament factor of 2.37; average lobe angle was −35.4 degrees, having filament cross-sections similar in appearance to FIG. 2A. Comparative Example II-A yarn was comprised of fine trilobal filaments not of the invention, having average filament factor of 0.77; average lobe angle was +18.6 degrees, having filament cross-sections similar in appearance to FIG. 9. Comparative Example II-B was a unitary 200-filament yarn as described in U.S. Pat. Nos. 5,741,587 and U.S. Pat. No. 5,827,464 and having round cross-section filaments. Physical properties and cross section parameters of the as-spun yarns are listed in Table II-1.

Yarns II-1, II-A, and II-B were draw false-twist textured using a Barmag L-900 texturing machine equipped with polyurethane discs and using 1.506 draw ratio, 1.711 D/Y ratio, 180° C. first heater temperature. The trilobal yarn of Example II-A was not textured at these conditions because of the high draw tension of this example. The draw-textured yarns had denier per filament (dpf) of approximately 0.8, i.e., the draw-textured filaments were "subdeniers" or "microfibers" by virtue of having denier per filament below 1. Properties of the draw-textured yarns are given in Table II-2.

Consistent with the observation of Example I, the feed yarn of Example II-1 had lower draw tension, higher tenacity-at-break ($T_B$) and higher elongation compared to the trilobal yarn of Comparative Example II-A. The 3-lobe yarn of the invention had draw tension level similar to that of the round control yarn, and could be textured using the same draw-texturing conditions. The textured 3-lobe yarn of the invention had a low level of textured yarn broken filaments that was equivalent to that of the round control.

Black-dyed, circular-knit fabrics were made from draw-textured yarns II-1, II-A, and II-B using equivalent fabric construction and dyeing conditions. Fabrics were rated for relative glitter and shine under bright sunlight viewing, and rated for relative covering power under diffuse room lighting. The fabric made from Example II-1 yarns having subdenier filaments of three lobes and "filament factor" ≧2 had significantly lower glitter and shine (higher numerical ratings), and greater covering power when compared to the round cross-section filament yarn of Comparative Example II-B. Fabric ratings are shown in Table II-3.

TABLE II-2

TEXTURED YARN PROPERTIES

| Ex. | Text. Denier | Text. dpf | Text. Tenacity (gpd) | Text. Elo. (%) | Text. Tb (gpd) | Leesona Shrinkage (%) | Fray Count (bf/1000 meters) |
|---|---|---|---|---|---|---|---|
| II-1 | 166 | 0.83 | 4.27 | 51.2 | 6.46 | 7.09 | 6.7 |
| II-A | not textured | | | | | | |
| II-B | 152 | 0.76 | 4.35 | 50.6 | 6.55 | 6.78 | 6.7 |

TABLE II-3

FABRIC RATINGS

| Ex. | Fabric Ratings | | |
|---|---|---|---|
| | Shine Rating | Covering Power | Glitter Rating |
| II-1 | 8 | 6 | 6 |
| II-A | | | |
| II-B | 1.5 | 1 | 1 |

Example III

Yarns comprised of fine filaments of nominal 1.4 dpf and 3-lobes were produced essentially as described in Example II, except that 88-filament yarn bundles were combined prior to takeup to produce 176-filament yarn bundles. Examples III-1 and III-2 yarns were comprised of fine 3-lobe filaments having average filament factor of ≧2 and having cross-sections in appearance similar to FIG. 2A. The polymer of Example III-1 contained 1.0% $TiO_2$ and was of nominal 20.2 LRV, whereas the polymer of Example III-2 contained 0.30% $TiO_2$ and was of nominal 21.7 LRV. Comparative Example III-A polymer contained 1.5% $TiO_2$ and was of nominal 20.6 LRV, and the Comparative Example III-A yarn was comprised of round filaments. The spinning speed of each Example III-1, III-2, and III-A was adjusted to achieve a draw tension of about 0.45 grams/denier. Physical properties and cross section parameters of the as-spun yarns are listed in Table III-1.

Yarns III-1, III-2, and III-A were draw false-twist textured using a Barmag L-900 texturing machine equipped with polyurethane discs and using 1.506 draw ratio, 1.711 D/Y ratio, 180° C. first heater temperature. The draw-textured yarns had denier per filament (dpf) of approximately 0.95; i.e., the draw-textured filaments were "subdeniers" or "microfibers" by virtue of having denier per filament below 1. Properties of the draw-textured yarns are given in Table III-2.

Black-dyed, circular-knit fabrics were made from draw-textured yarns III-1, III-2, and III-A using equivalent fabric construction and dyeing conditions. Fabrics were rated for relative glitter and shine under bright sunlight viewing, and rated for relative color depth and covering power under diffuse room lighting. The fabrics made from Example III yarns comprised of draw-textured, subdenier, 3-lobe filaments of the invention had equal luster ratings. This was surprising given that Example III-1 contained 1.0% added delusterant ($TiO_2$), whereas Example III-2 contained 0.30% added delusterant ($TiO_2$). Both fabrics from Examples III-1 and III-2 had lower glitter (higher numerical ratings) than fabrics made from Comparative Example III-A yarn comprised of round filaments, even though the polymer used in Comparative Example III-A had significantly higher added delusterant (1.5% $TiO_2$) than either Example III-1 or III-2. The use of the multilobal cross section with a filament factor ≧2 had a much greater delustering effect, i.e., reduction of glitter, in fabrics made from the fine subdenier textured filaments than did increasing the level of delusterant added to the polymer, which was very surprising. The use of increased delusterant level did however have a significant negative effect on the quality of the textured yarn, as evidenced by the increasing level of textured yarn broken filaments (fray count) as the level of added $TiO_2$ was increased.

A very significant delustering effect was obtained in draw false-twist textured subdenier yarns and fabrics by using multilobal filaments having a filament factor ≧2, when compared to prior art filaments having round or trilobal cross sections. Delustering of these fine filament yarns was best achieved by the cross section change and not by increasing the delusterant ($TiO_2$) level, even when using "dull" polymers having 1.0% to 1.5% $TiO_2$. This benefit of the high filament factor, multilobal filaments was surprising, in view of prior art, which stated that by reducing the dpf sufficiently, "glitter-free yarns could be produced after texturing regardless of the starting cross-section". (McKay, U.S. Pat. No. 3,691,749) A second surprising benefit of the high filament factor multilobal fine and subdenier filaments was that the spinning orientation level, as indicated by draw tension and % elongation to break, and the filament tenacity-at-break ($T_B$=Tenacity*(1+% Elongation/100%) were similar to those of round filaments. It is hypothesized that the rounded, relatively large-area lobes having high tip (radius) ratios contributed to a more uniform and slower quenching compared to the more pointed tips of the standard trilobal filaments having positive lobe angle and low tip ratio. It was further surprising that the negative lobe angle trilobal filaments, even though they had larger lobe areas due to the high tip (radius) ratio, gave lower glitter after draw false-twist texturing than the smaller-lobed standard trilobal filaments. McKay, U.S. Pat. No. 3,691,749 and Duncan U.S. Pat. No. 4,040,689 both stated that "lobe angles which are positive are especially preferred in the feed yarns of the invention for lobes of this type are less likely to flatten in texturing".

TABLE III-2

TEXTURED YARN PROPERTIES

| Ex. | Text. Denier | Text. Dpf | Text. Tenacity (gpd) | Text. Elo. (%) | Text. Tb (gpd) | Leesona Shrinkage (%) | Fray Count (bf/1000 meters) |
|---|---|---|---|---|---|---|---|
| III-1 | 167 | 0.95 | 3.82 | 43.4 | 5.48 | 5.83 | 6.5 |
| III-A | 167 | 0.95 | 4.00 | 52.6 | 6.10 | 7.83 | 12.5 |
| III-2 | 165 | 0.94 | 3.92 | 43.4 | 5.62 | 6.20 | 1.1 |

Example IV

Figure 6:
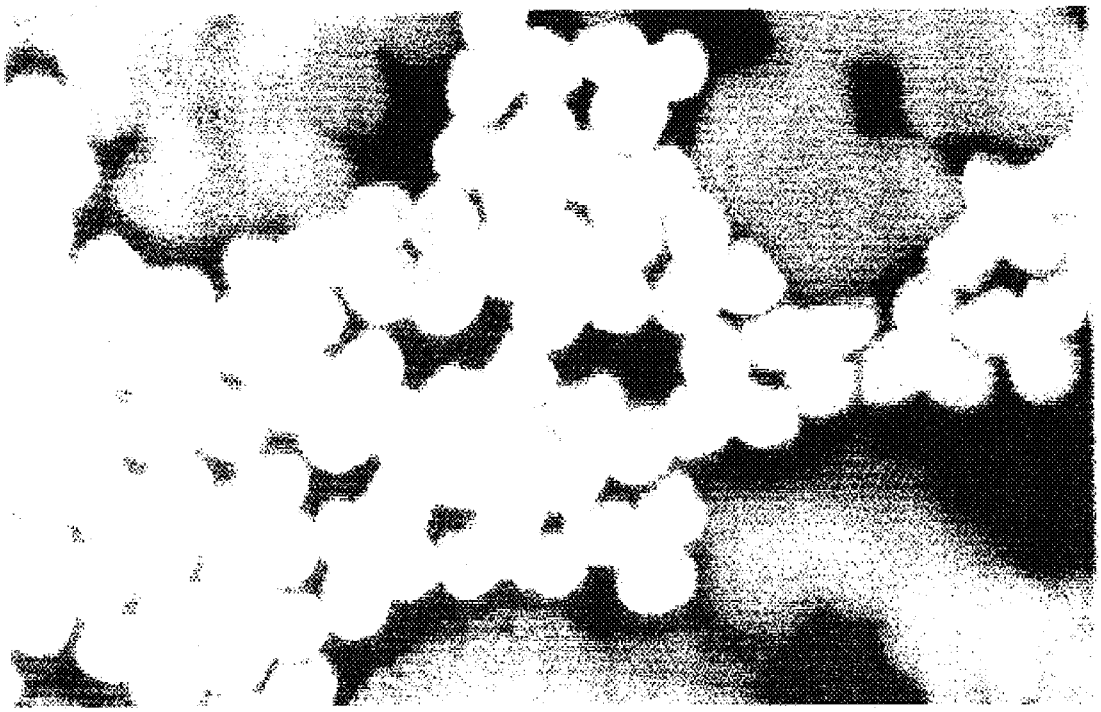
FIG. 6 is a cross-section of subdenier trilobal filaments of the present invention, having an average DPF of 0.72, MR of 2.41, TR of 0.45, lobe angle of −51 degrees, and FF of 4.5.

Yarns comprised of 88 fine filaments of nominal 0.84 dpf and of 100 fine filaments of nominal 0.75 dpf were spun from poly(ethylene terephthalate) of nominal 21.7 LRV and containing 0.035 weight percent $TiO_2$. Spinning process was similar to that described in Example I, except spinning speed was increased to 4645 ypm (4247 meters/minute) to spin nominal 75 denier, 88 and 100 filament low-shrinkage yarns suitable as direct-use textile yarns for knits and wovens and as feed yarns for air-jet and stuffer-box texturing wherein no draw is required. Example IV-1 was a yarn comprised of 88 filaments of nominal 0.84 dpf and filament cross-section having 3 lobes and average filament factor of 5.01. Comparative Example IV-A was a yarn comprised of 100 round filaments of nominal 0.75 dpf. Example IV-2 was a yarn comprised of 100 filaments of nominal 0.75 dpf and filament cross-section having 3 lobes and average filament factor of 3.69. Examples IV-1 and IV-2 had filament cross-sections in appearance similar to FIG. 6. Comparison Example IV-B was a yarn comprised of 100 trilobal filaments of nominal 0.75 dpf and filament cross-section having average filament factor of 1.76 and having filament cross-sections in appearance similar to FIG. 9. Yarns IV-1, IV-2, IV-A, and IV-B were "subdeniers" or "microfibers" by virtue of having denier per filament below 1. Comparison Example IV-C was a yarn comprised of 34 trilobal filaments of nominal 2.2 dpf and having average filament factor of 0.21. Physical properties and cross-section parameters are listed in Table IV-1. Draw tension results in this table were measured at 1.40 draw ratio and 150 ypm (137 meters/minute) feed rate.

Black-dyed, circular-knit fabrics were made from as-spun, direct-use yarns IV-1, IV-2, IV-A, IV-B, and IV-C using equivalent fabric construction and dyeing conditions. Fabrics were rated for relative glitter and shine under bright sunlight viewing, and rated for relative covering power and color depth under diffuse room lighting. The fabrics made from Examples IV-1 and IV-2 yarns having subdenier filaments of three lobes and "filament factor" $\geqq 2$ had significantly less (higher numeric ratings) glitter and shine compared to the trilobal filament yarns IV-B and IV-C, and greater covering power when compared to the round cross-section filament yarn of Example IV-A. Furthermore, the fabrics made from Examples IV-1 and IV-2 had significantly greater depth of color when compared to fabric made using the prior-art trilobal subdenier Comparative Example IV-C. It was surprising that the subdenier 0.85 dpf Example IV-1 yarn gave equivalent fabric depth of color to the 2.2 dpf Comparative Example IV-C yarn, which was unexpected in view of the significantly greater filament denier of the Comparative Example IV-C yarn. Fabric visual ratings are shown in Table IV-2. The fabrics made from Examples IV-1 and IV-2 multilobal subdenier yarns of the invention also had a combination of rapid moisture wicking and high thermal conductivity, making this type yarn especially suitable for performance fabric applications such as athletic wear.

TABLE IV-2

| | FABRIC RATINGS | | | |
|---|---|---|---|---|
| Ex. | Shine Rating | Covering Power | Glitter Rating | Color Depth |
| IV-1 | 7 | 5 | 7 | 5 |
| IV-A | 5 | 1 | 6 | 8 |
| IV-2 | 5 | 7 | 6 | 3 |

TABLE IV-2-continued

| | FABRIC RATINGS | | | |
|---|---|---|---|---|
| Ex. | Shine Rating | Covering Power | Glitter Rating | Color Depth |
| IV-B | 0 | 6 | 0 | 0 |
| IV-C | 2 | 2 | 2 | 5 |

Example V

Yarns comprised of fine spin-oriented filaments were prepared from basic-dyeable ethylene terephthalate copolyester containing 1.35 mole percent of lithium salt of a glycollate of 5-sulfo-isophthalic acid and of nominal 18.1 LRV, said polymer being essentially as described in U.S. Pat. No. 5,559,205 and U.S. Pat. No. 5,607,765. Polymer contained 0.30 weight percent of $TiO_2$. Yarns were spun at 2450 ypm (2240 meters/minute) using spinning process essentially as described in Example I. Example V-1 yarn was comprised of 88 filaments of nominal 1.31 dpf and filament cross section having 3 lobes and average filament factor of 2.97, and having filament cross-sections in appearance similar to FIG. 2A. Comparative Example V-A yarn was comprised of 100 round filaments of nominal 1.15 dpf. Comparative Example V-B yarn was comprised of 100 filaments of nominal 1.15 dpf and having a trilobal cross-section with average filament factor of 0.72, and having filament cross-sections in appearance similar to FIG. 9. Example V-2 yarn was comprised of 100 filaments of nominal 1.15 dpf and filament cross section having 3 lobes and average filament factor of 2.77, and having filament cross-sections in appearance similar to FIG. 2A. A summary of yarn physical properties and filament cross-section parameters is in Table V-1.

Yarns V-1, V-2, V-A, and V-B were draw false-twist textured using the same texturing conditions on a Barmag L-900 texturing machine equipped with polyurethane discs and using 1.506 draw ratio, 1.635 D/Y ratio, 160° C. first heater temperature. The Example V-1 draw-textured yarn had a denier per filament (dpf) of approximately 0.89 and the draw-textured yarns of Examples V-A, V-B, and V-2 had dpf of approximately 0.78, i.e., the draw-textured filaments were "subdeniers" or "microfibers" by virtue of having denier per filament below 1. Properties of the draw-textured yarns are given in Table V-2. The three-lobe yarns of Examples V-1 and V-2 had lower feed yarn draw tension, and higher tenacity-at-break ($T_B$) and higher elongation in both as-spun and draw-textured forms compared to the trilobal yarn of Comparative Example V-B. The 3-lobe filament yarns of the invention had spun yarn draw tension and elongation values very similar to those of the round cross-section comparison yarn, even when spun at identical spinning speeds, which was very surprising. It was expected that, when spun at equal speeds and quenching conditions, non-round cross-section filaments would have higher orientation (e.g., higher draw tension) and lower elongation when compared to round filaments, because the non-round filaments were expected to quench more rapidly due to the increased fiber surface area. Textured yarn broken filaments (fray count) were at a low level for the 3-lobe, basic-dyeable, subdenier yarns of the invention, whereas fray count was very high for the textured trilobal cross-section multifilament yarn of Comparative Example V-B.

Black-dyed, circular-knit fabrics were made from draw-textured yarns V-A, V-B, and V-2 using equivalent fabric construction and dyeing conditions. Fabrics were rated for relative glitter and shine under bright sunlight viewing, and rated for relative covering power and color depth under diffuse room lighting. The fabric made from Example V-2 yarns having subdenier basic-dyeable filaments of three lobes and "filament factor" ≧2 had significantly less glitter and shine (higher numerical ratings) when compared to the textured round and trilobal Comparative Examples V-A and V-B, and greater covering power when compared to the round cross-section filament yarn of Example V-A. The fabric made from Example V-2 trilobal subdenier false-twist textured yarns of the invention also had greater depth of color when compared to fabric made from prior-art trilobal subdenier false-twist textured yarn of Example V-C. Fabric ratings are shown in Table V-3.

TABLE V-2

| Ex. | Text. Denier | Text. dpf | Text. Tenacity (gpd) | Text. Elo. (%) | Text. Tb (gpd) | Leesona Shrinkage (%) | Fray Count (bf/1000 meters) |
|---|---|---|---|---|---|---|---|
| V-1 | 78 | 0.89 | 2.95 | 36.3 | 4.02 | 8.36 | 2.2 |
| V-A | 79 | 0.79 | 3.08 | 43.9 | 4.43 | 9.43 | 20.1 |
| V-B | 78 | 0.78 | 3.05 | 31.5 | 4.01 | 8.85 | 232.0 |
| V-2 | 78 | 0.78 | 3.00 | 35.4 | 4.06 | 7.61 | 11.2 |

TABLE V-3

FABRIC RATINGS

| Ex. | Shine Rating | Covering Power | Glitter Rating | Color Depth |
|---|---|---|---|---|
| V-A | 1 | 1 | 1 | 9 |
| V-B | 5 | 7 | 5 | 1 |
| V-2 | 9 | 7 | 9 | 5 |

Example VI

Figure 7A:
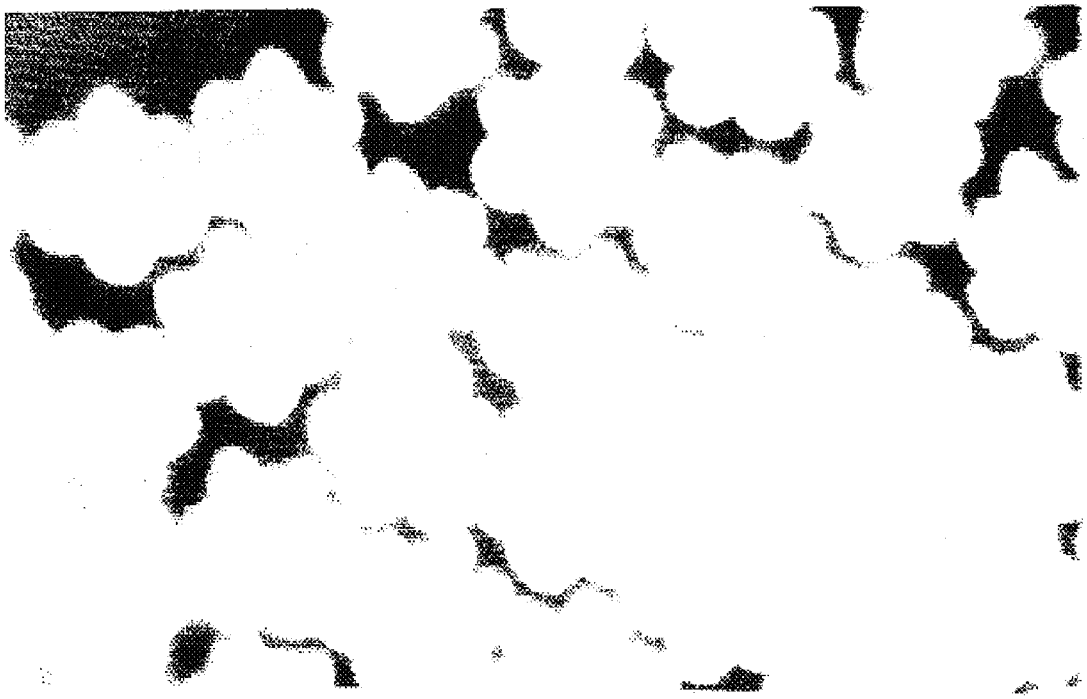
FIG. 7A represents the cross-section of the filaments as-spun, having an average DPF of 1.62, MR of 1.38, TR of 0.32, lobe angle of −5.4 degrees, and FF of 11.0.

Basic-dyeable feed yarns comprised of 34 filaments of nominal 2.4 dpf were prepared using polymer essentially as described in Example V. Comparative Example VI-A yarn was comprised of 34 filaments having round cross-section. Comparative Example VI-B yarn was comprised of 34 filaments having trilobal cross-section with average filament factor of 0.39 and average lobe angle of +19.7 degrees. Example VI-1 yarn was comprised of 34 filaments having 6-lobe cross-section with average lobe angle of −9.1 degrees and average filament factor of 6.98, and having filament cross-sections in appearance similar to FIG. 7A. Example VI-2 yarn was comprised of 34 filaments having 3-lobe cross-section with average lobe angle of −52.6 degrees and average filament factor of 4.07. Yarn physical properties and cross-section parameters are listed in Table VI-1.

Yarns VI-A, VI-B, VI-1, and VI-2 were draw false-twist textured using the same texturing conditions on a Barmag L-900 texturing machine equipped with polyurethane discs and using 1.44 draw ratio, 1.635 D/Y ratio, 160° C. first heater temperature. The draw false-twist textured yarns of Examples VI had dpf of approximately 1.7; i.e., these yarns were comprised of filaments having dpf above the subdenier level. Properties of the draw-textured yarns are given in Table VI-2.

Figure 7B:
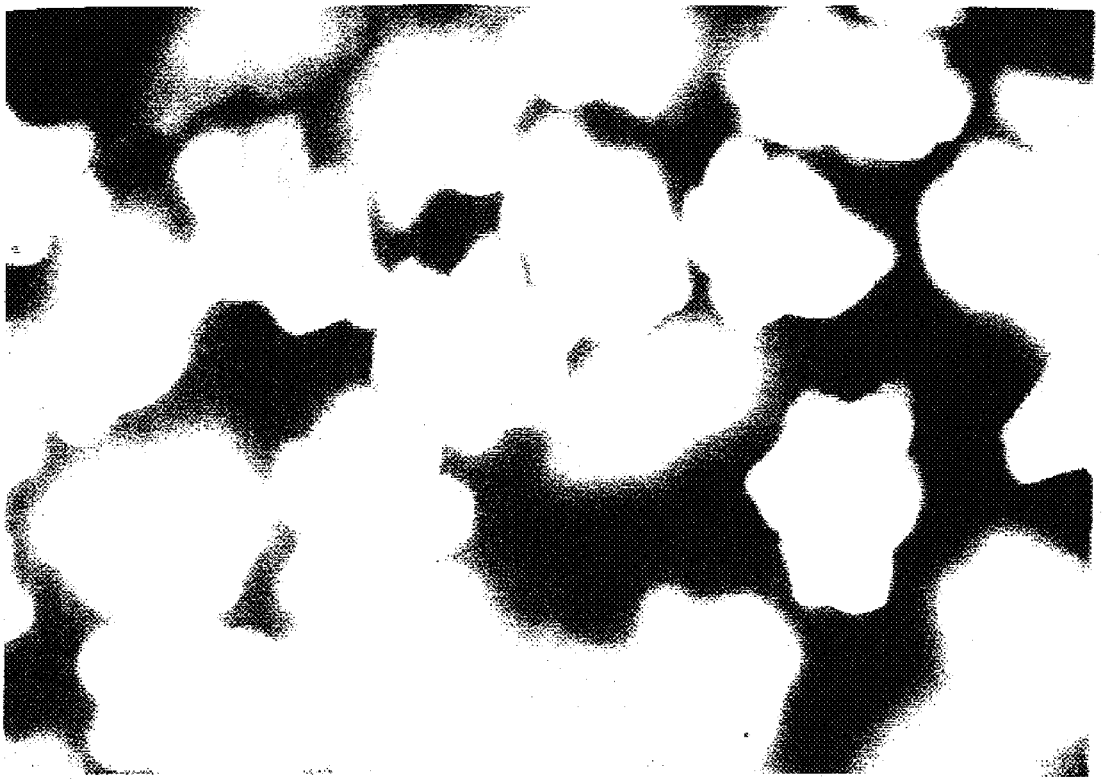
FIG. 7B represents the cross-section of the filaments after draw false-twist texturing at a 1.44 draw ratio.

Black-dyed, circular-knit fabrics were made from draw-textured yarns VI-A, VI-B, VI-1, and VI-2 using equivalent fabric construction and dyeing conditions. Fabrics were rated for relative glitter and shine under bright sunlight viewing, and rated for relative covering power under diffuse room lighting. The fabrics made from Examples VI-1 and VI-2 yarns having basic-dyeable multilobal filaments and "filament factor" ≧2 had significantly lower glitter and shine (higher numerical ratings) when compared to the textured round and trilobal Comparative Examples VI-A and VI-B, and greater covering power when compared to the round cross-section filament yarn of Example VI-A. Fabric ratings are shown in Table VI-3. The draw-textured 6-lobe filaments of Example VI-1 had filament cross-sections in appearance similar to FIG. 7B, which exhibited some lobe distortion from the false-twist texturing process but retained in general filaments with six distinct lobes and along-fiber grooves, said filaments providing low fabric glitter even after draw false-twist texturing.

TABLE VI-2

TEXTURED YARN PROPERTIES

| Ex. | Text. Denier | Text. dpf | Text. Tenacity (gpd) | Text. Elo. (%) | Text. Tb (gpd) | Leesona Shrinkage (%) | Fray Count (bf/1000 meters) |
|---|---|---|---|---|---|---|---|
| VI-A | 58 | 1.69 | 2.72 | 69.7 | 4.62 | 16.14 | 0.0 |
| VI-B | 57 | 1.68 | 2.62 | 47.1 | 3.85 | 13.01 | 0.0 |
| VI-1 | 57 | 1.68 | 2.75 | 46.4 | 4.03 | 10.84 | 0.0 |
| VI-2 | 57 | 1.68 | 2.72 | 44.4 | 3.93 | 10.29 | 0.0 |

TABLE VI-3

FABRIC RATINGS

| Ex. | Shine Rating | Covering Power | Glitter Rating |
|---|---|---|---|
| VI-A | 5 | 1 | 1 |
| VI-B | 3 | 8 | 5 |
| VI-1 | 13 | 8 | 13 |
| VI-2 | 10 | 11 | 10 |

Example VII

Basic-dyeable feed yarns comprised of 34 filaments of nominal 1.9 dpf, or of 50 filaments of nominal 1.3 dpf, were prepared using polymer essentially as described in Example V. Comparative Example VII-A yarn was comprised of 34 filaments having round cross-section and nominal 1.9 dpf. Comparative Example VII-B yarn was comprised of 34 filaments of nominal 1.9 dpf and having trilobal cross-section with average filament factor of 0.50 and average lobe angle of +19.2 degrees. Example VII-1 yarn was comprised of 34 filaments having 6-lobe cross-section with average lobe angle of −7.7 degrees and average filament factor of 8.86. Example VII-2 yarn was comprised of 34 filaments having 3-lobe cross-section with average lobe angle of −51.3 degrees and average filament factor of 4.21. Comparative Example VII-C yarn was comprised of 50 filaments of nominal 1.3 dpf and having trilobal cross-section with average filament factor of 0.68 and average lobe angle of +24.8 degrees. Example VII-3 yarn was comprised of 50 filaments of nominal 1.3 dpf and having 6-lobe cross-section with average lobe angle of +22.8 degrees and average filament factor of 10.2. Yarn physical properties and cross-section parameters are listed in Table VII-1.

Yarns VII-1 through VII-3 and VII-A through VII-C were draw false-twist textured using the same texturing conditions on a Barmag L-900 texturing machine equipped with polyurethane discs and using 1.44 draw ratio, 1.635 D/Y ratio, 160° C. first heater temperature. The draw false-twist textured yarns of Examples VII-1, VII-2, VIII-A, and VII-B had dpf of approximately 1.4; i.e., these yarns were comprised of filaments having dpf above the subdenier level. The draw false-twist textured yarns of Examples VII-C and VII-3 had dpf of approximately 1. Properties of the draw-textured yarns are given in Table VII-2.

Black-dyed, circular-knit fabrics were made from the draw-textured yarns of Example VII using equivalent fabric construction and dyeing conditions. Fabrics were rated for relative glitter and shine under bright sunlight viewing, and rated for relative covering power under diffuse room lighting. Fabric glitter and shine were reduced (higher numerical ratings) by reducing the yarn dpf when a similar cross-section was maintained. Fabrics could be made using the higher 1.4 dpf filaments and having equal or lower fabric glitter and shine to fabrics constructed of finer 1.0 dpf filaments, when the higher dpf yarns used multilobal filaments with high filament factors of the invention. Fabric ratings are shown in Table VII-3.

TABLE VII-2

TEXTURED YARN PROPERTIES

| Ex. | Text. Denier | Text. dpf | Text. Tenacity (gpd) | Text. Elo. (%) | Text. Tb (gpd) | Leesona Shrinkage (%) | Fray Count (bf/1000 meters) |
|---|---|---|---|---|---|---|---|
| VII-A | 49 | 1.44 | 2.62 | 78.8 | 4.68 | 10.97 | 0.0 |
| VII-B | 49 | 1.44 | 2.51 | 53.0 | 3.84 | 10.22 | 0.0 |
| VII-1 | 49 | 1.44 | 2.60 | 49.4 | 3.88 | 8.09 | 2.2 |
| VII-2 | 49 | 1.44 | 2.61 | 51.4 | 3.95 | 7.39 | 0.0 |
| VII-C | 50 | 1.00 | 2.52 | 44.3 | 3.64 | 8.75 | 0.0 |
| VII-3 | 50 | 0.99 | 2.59 | 40.2 | 3.63 | 8.17 | 0.0 |

TABLE VII-3

FABRIC RATINGS

| Ex. | Shine Rating | Covering Power | Glitter Rating |
|---|---|---|---|
| VII-A | 7 | 1 | 1 |
| VII-B | 5 | 8 | 5 |
| VII-1 | 19 | 10 | 17 |
| VII-2 | 9 | 11 | 11 |
| VII-C | 7 | 14 | 11 |
| VII-3 | 19 | 18 | 21 |

Example VIII

Figure 8:
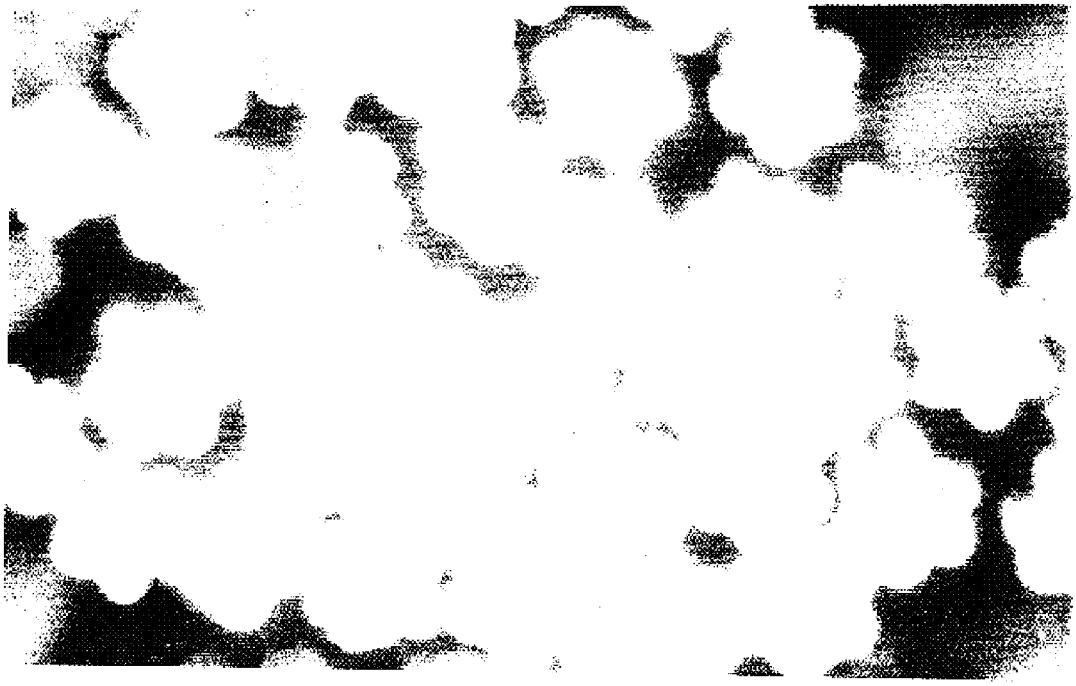
FIG. 8 is a cross-section of hexalobal filaments of the present invention as spun, having an average DPF of 0.99, MR of 1.33, TR of 0.35, lobe angle of 4.8 degrees, and FF of 16.7.

Direct-use spin-oriented yarns comprised of 50 through 100 filaments and 0.7 through 1.4 dpf were produced from basic-dyeable polymer as described in Example V. Spinning process was similar to that described in Example I, except spinning speed was increased to 4200 ypm (3840 meters/minute) to obtain yarns suitable as direct-use textile yarns for knits and wovens and as feed yarns for air-jet and stuffer-box texturing wherein no draw is required. Examples VIII-1, VIII-3 and VIII-5 yarns were comprised of 3-lobe filaments having filament factors ≧2, and having filament cross-sections in appearance similar to FIG. 6. Examples VIII-2 and VIII-4 yarns were comprised of 6-lobe filaments having filament factors ≧2, and having filament cross-sections in appearance similar to FIG. 8. Comparative Example VIII-A was comprised of round cross-section filaments. Comparative Examples VIII-B and VIII-C were comprised of trilobal filaments having filament factors below 2, and having filament cross-sections in appearance similar to FIG. 9. Summary of yarn physical properties and filament geometric parameters is given in Table VIII-1. Draw tension results in this table were measured at 1.40 draw ratio and 150 ypm (137 meters/minute) feed rate.

Black-dyed, circular-knit fabrics were made from the as-spun, direct-use yarns VIII-1 through VIII-3 and VIII-A through VIII-C using equivalent fabric construction and dyeing conditions. Fabrics were rated for relative glitter and shine under bright sunlight viewing, and rated for relative color depth and covering power under diffuse room lighting. The fabrics made from the multilobal yarns having filament factors ≧2 exhibited improved cover when compared to fabrics constructed of the comparison examples of equivalent dpf. The fabrics made from the multilobal yarns having filament factors ≧2 exhibited lower combined glitter and shine (higher combined glitter and shine numerical ratings) and greater depth of color when compared to fabrics constructed of comparison examples of equivalent dpf and having trilobal cross-sections with low filament factors below 2.

TABLE VIII-2

FABRIC RATINGS

| Ex. | Shine Rating | Color Depth | Covering Power | Glitter Rating |
|---|---|---|---|---|
| VIII-A | 0 | 1.5 | 0 | 1 |
| VIII-1 | 2 | 1 | 2 | 1 |
| VIII-B | 0 | 2.5 | 1.5 | 0 |
| VIII-2 | 4 | 5 | 2.5 | 4 |
| VIII-C | 3 | 0.5 | 4 | 4 |
| VIII-3 | 5 | 5 | 5 | 4 |

Example IX

Figure 3A:
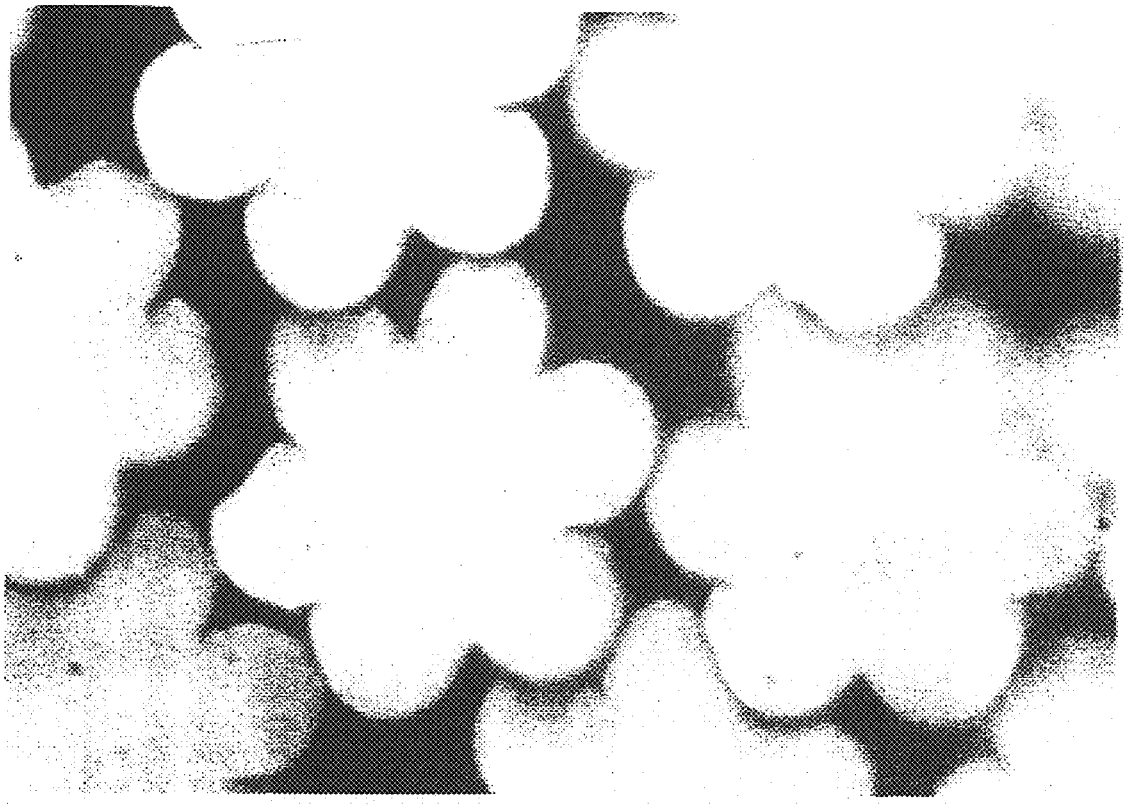
FIG. 3A represents the cross-section of the filaments as-spun, having an average DPF of 5.07, MR of 1.48, TR of 0.34, lobe angle of −18.8 degrees, and FF of 4.5.
Figure 4A:
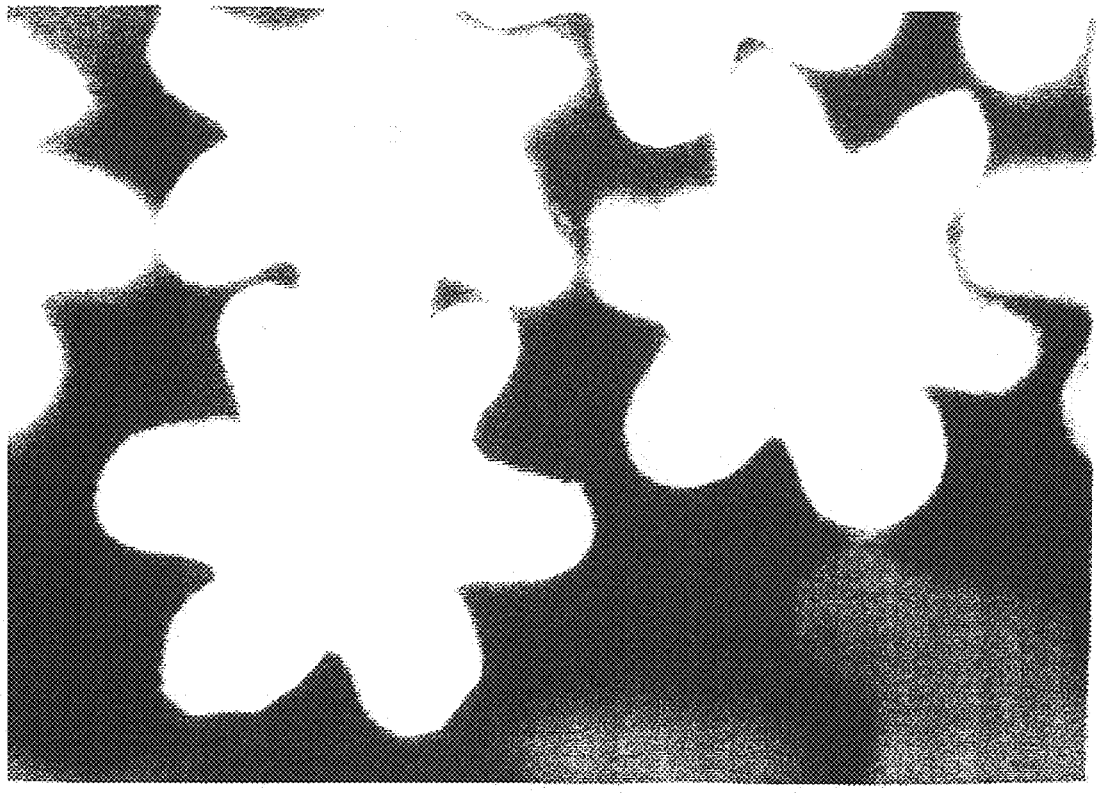
FIG. 4A represents the cross-section of the filaments as-spun, having an average DPF of 5.06, MR of 1.70, TR of 0.25, lobe angle of 3.8 degrees, and FF of 4.0.
Figure 5A:
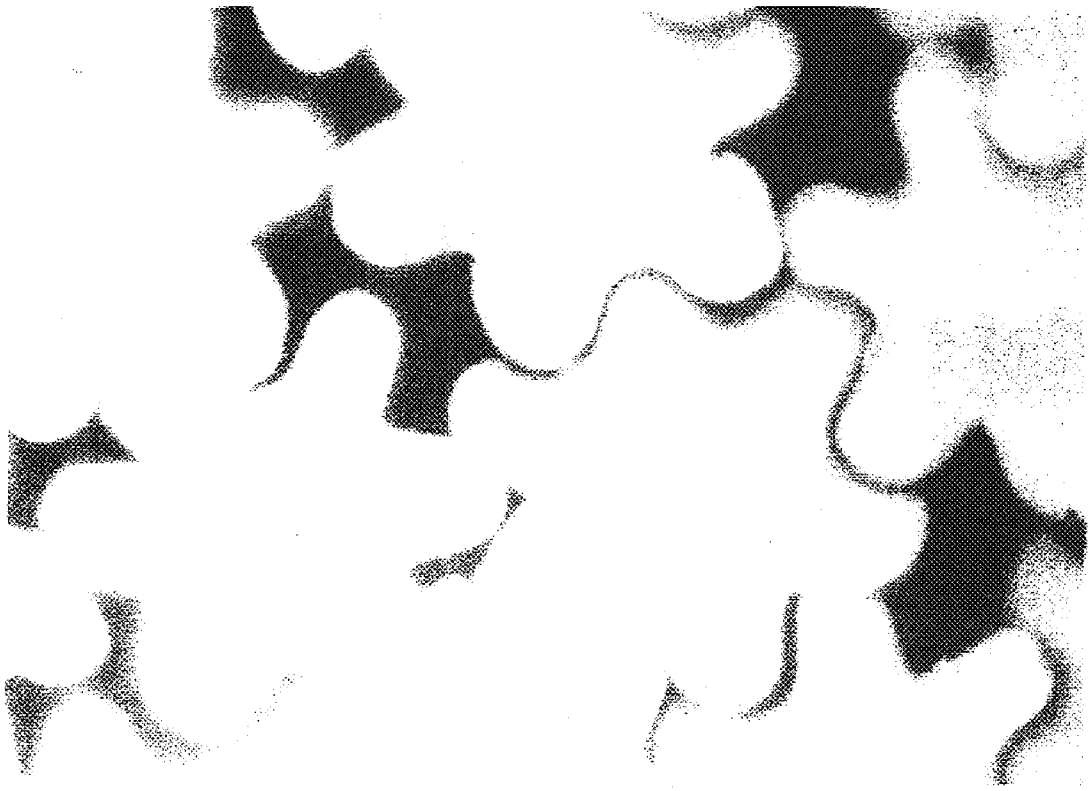
FIG. 5A represents the cross-section of the filaments as-spun, having an average DPF of 5.06, MR of 1.57, TR of 0.26, lobe angle of 6 degrees, and FF of 3.4.
Figure 10A:
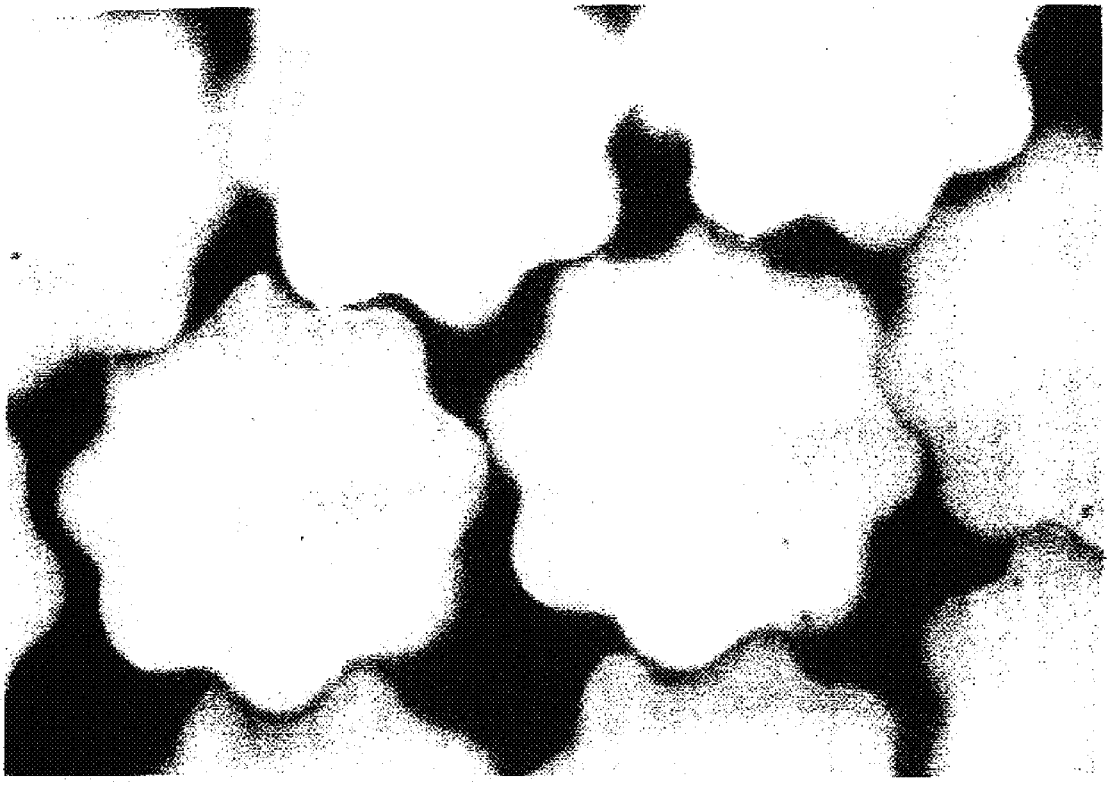
FIG. 10A represents a cross-section of the filaments as-spun, having an average DPF of 5.1, MR of 1.21, TR of 0.29, lobe angle of 86 degrees, and FF of −2.4.
Figure 10B:
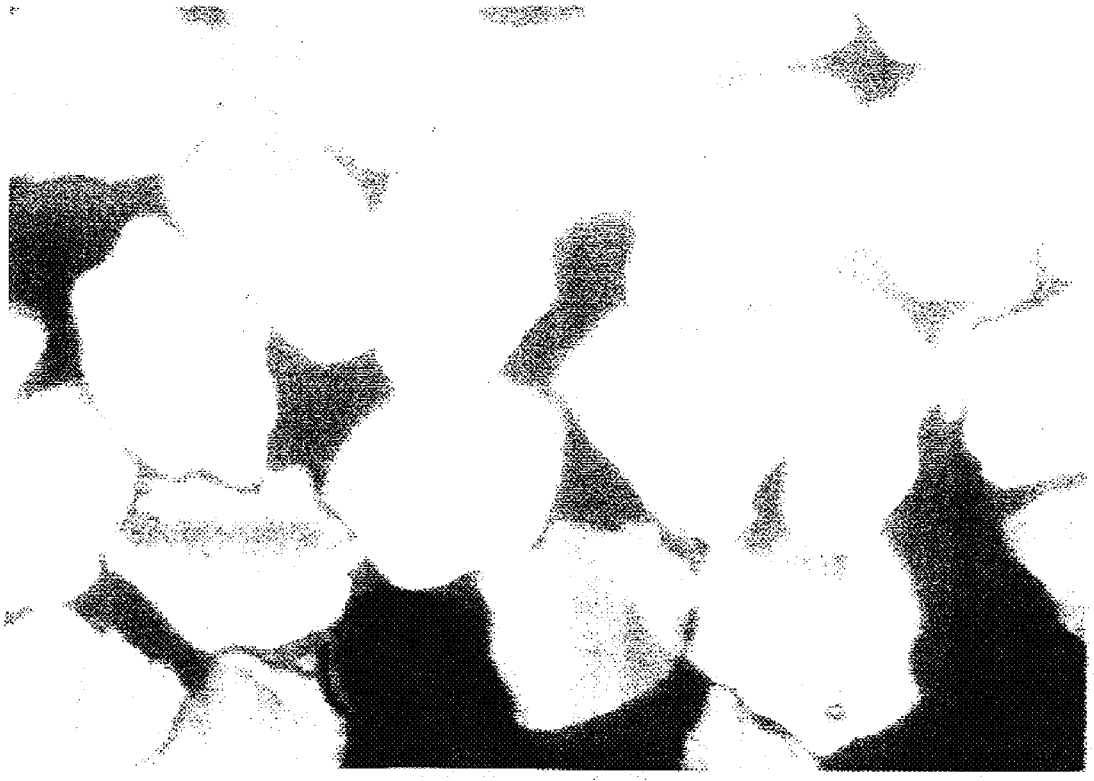
FIG. 10B represents the cross-section of the filaments after draw false-twist texturing at a 1.53 draw ratio.
Figure 11:
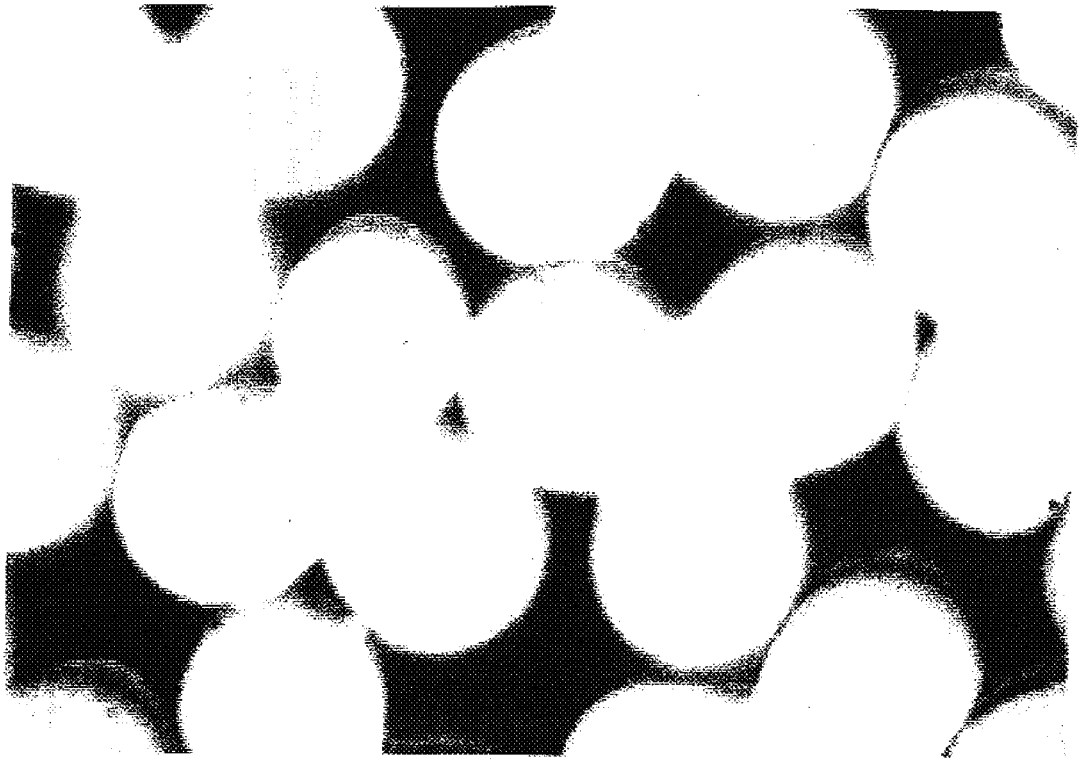
FIG. 11 is a comparative cross-section of trilobal filaments not within the scope of the present invention, having an average DPF of 5.05, MR of 2.26, TR of 0.45, lobe angle of −39 degrees, and FF of 1.3.

Yarns comprised of 50 filaments of nominal 5.1 dpf were spun from poly(ethylene terephthalate). The polyester polymer used in Examples IX-A, IX-B, and IX-1 through IX-5 was of nominal 20.6 LRV and contained 1.5 weight percent $TiO_2$ added delusterant. The polyester polymer used in Examples IX-C, IX-D, and IX-6 through IX-10 was of nominal 21.3 LRV and contained 0.30 weight percent $TiO_2$ as added delusterant. A modified cross flow quench system using a tubular delay assembly essentially as described in U.S. Pat. No. 4,529,368 was used in the spinning process. Comparative Examples IX-A and IX-C yarns were comprised of octalobal filaments essentially as described in U.S. Pat. No. 4,041,689 and having average filament factors of −3.36 and −2.39, respectively, and having filament cross-sections in appearance similar to FIG. 10A. Comparative Examples IX-B and IX-D yarns were comprised of filaments having 3 rounded lobes and average filament factors of 1.28 and 1.32, respectively, and having filament cross-sections in appearance similar to FIG. 11. Examples IX-2 and IX-7 yarns were comprised of filaments having 6 rounded lobes and average filament factors of 4.0 and 4.9, respectively, and having lobe angles of −19.6 degrees and −18.8 degrees, respectively, and having filament cross-sections in appearance similar to FIG. 3A. Examples IX-3, IX-4, IX-5, IX-8, IX-9 and IX-10 yarns were comprised of filaments having filament factors between 2.39 and 4.01 and having low average lobe angles generally about 15 degrees or less. Examples IX-4 and IX-9 had filament cross-sections in appearance similar to FIG. 4A, and were produced using spinneret capillaries illustrated in FIG. 1C. Examples IX-3 and IX-8 had filament cross-sections in appearance similar to FIG. 5A, and were produced using spinneret capillaries illustrated in FIG. 1B, which had a capillary leg length of about 0.457 mm. Examples IX-5 and IX-10 had filament cross-sections in appearance similar to FIG. 5A, and were produced using spinneret capillaries illustrated in FIG. 1B, but with capillary leg length increased from 0.457 mm to 0.508 mm. The spinneret capillaries of FIG. 1B or 1C may be modified to achieve different multilobal filaments having FF of at least 2, for example, by changing the number of capillary legs for a different desired lobe count, changing slot dimensions to change the geometric parameters, for production of a different DPF or as desired for use with various synthetic polymers. Examples IX-1 and IX-6 yarns were comprised of filaments having 8 lobes and average filament factors of 2.7 and 6.0, respectively. Yarn physical properties and cross-section parameters are listed in Table IX-1.

Figure 3B:
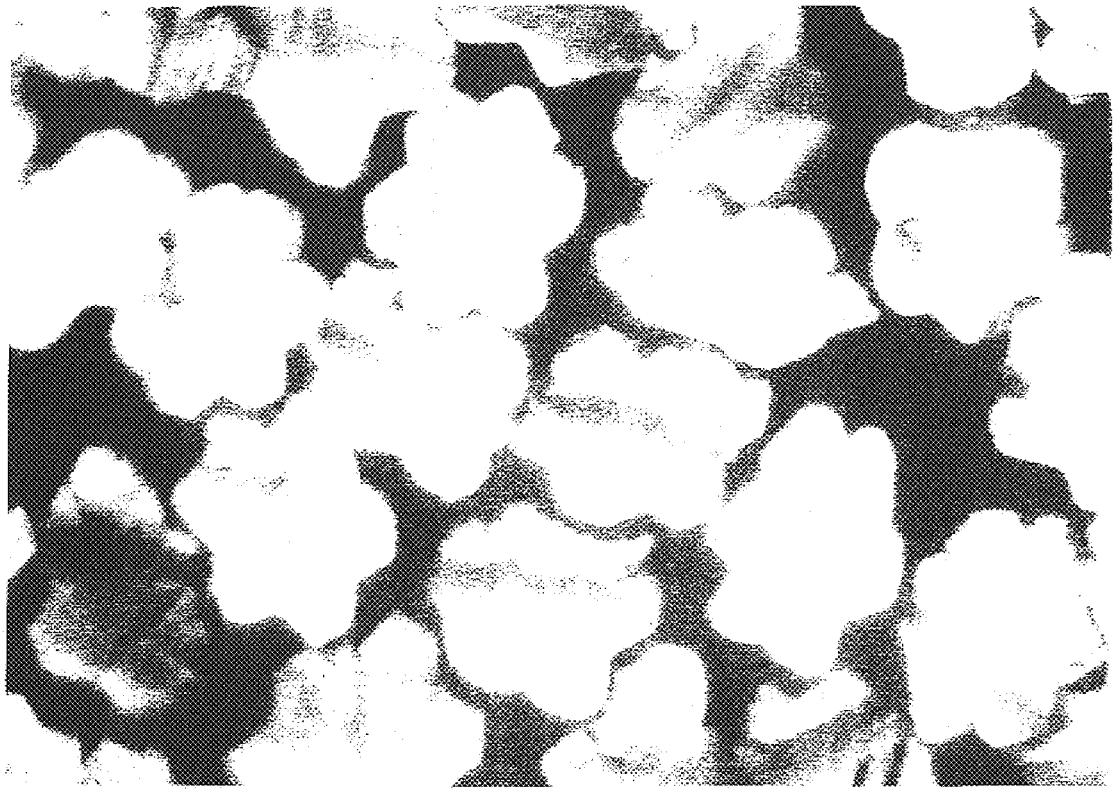
FIG. 3B represents the cross-section of the filaments after draw false-twist texturing at a 1.53 draw ratio.
Figure 4B:
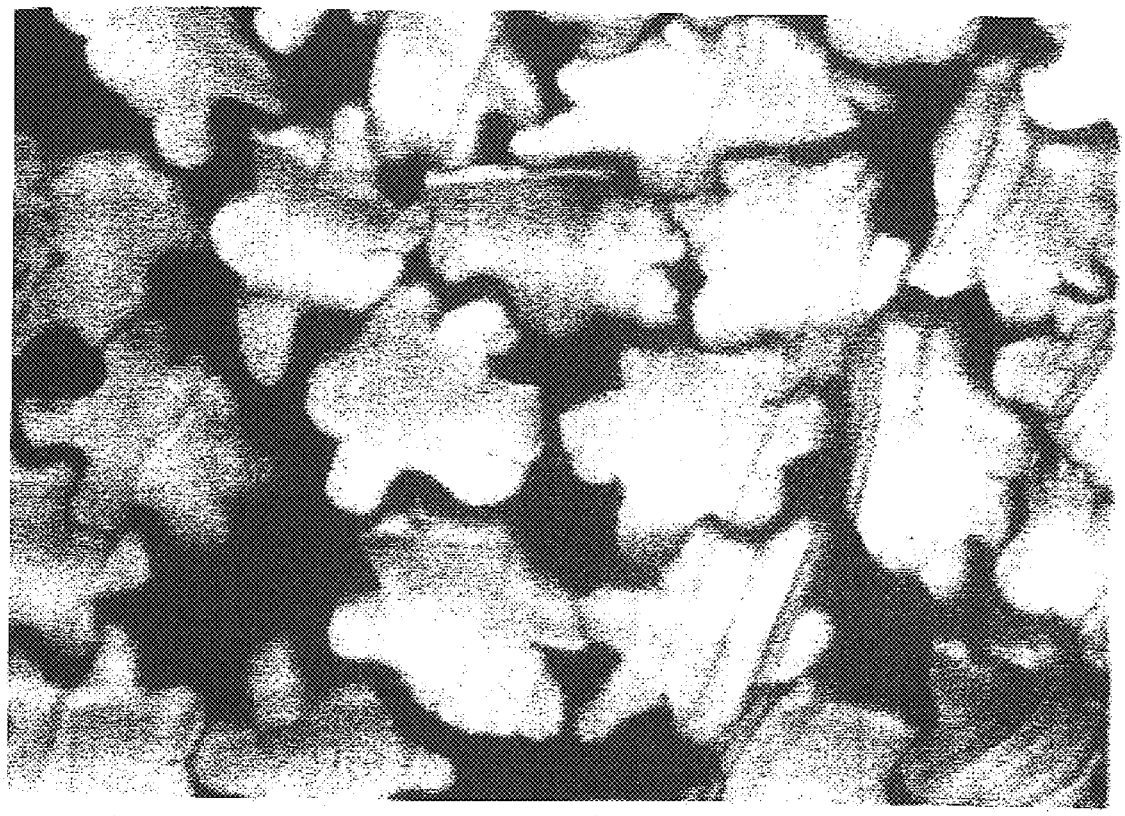
FIG. 4B represents the cross-section of the filaments after draw false-twist texturing at a 1.53 draw ratio.
Figure 5B:
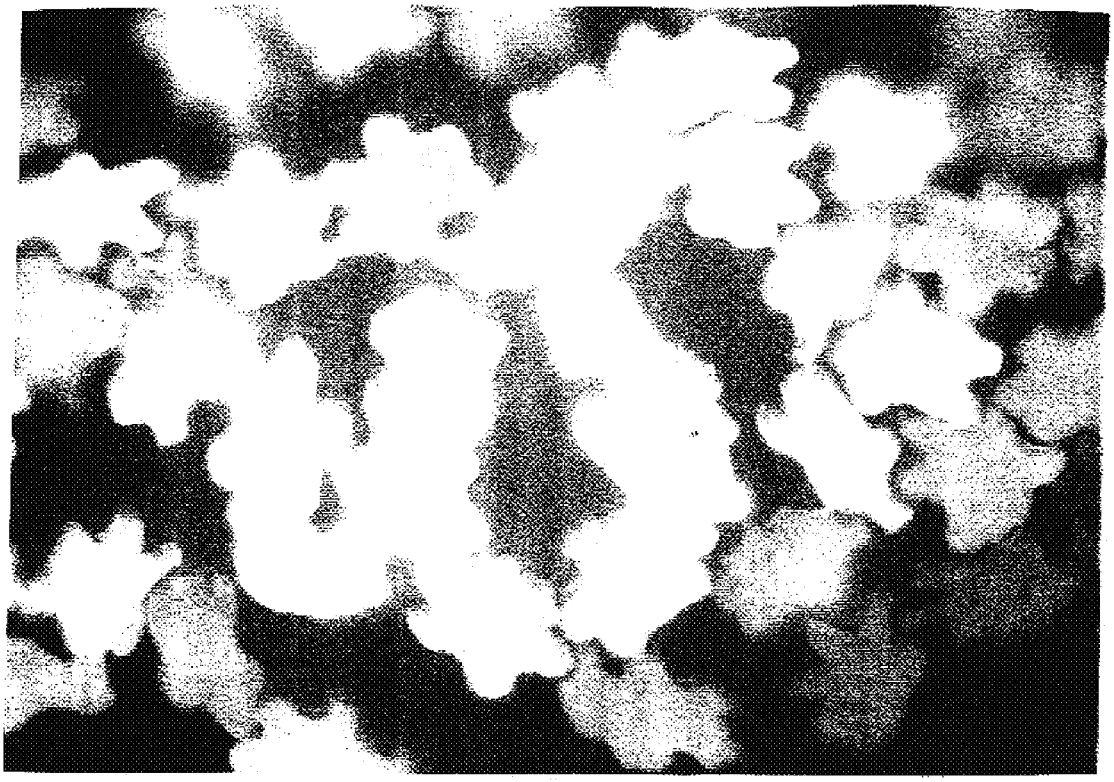
FIG. 5B represents the cross-section of the filaments after draw false-twist texturing at a 1.53 draw ratio.

Yarns of Example IX were draw false-twist textured using a Barmag AFK texturing machine equipped with polyurethane discs and using 1.53 draw ratio, 1.51 D/Y ratio and 210° C. first heater temperature. The draw-textured yarns had a denier per filament (dpf) of approximately 3.4. The draw textured yarns of Example IX had tensile properties and had low levels of textured yarn broken filaments suitable for high speed commercial fabric forming processes such as weaving and knitting. Properties of the draw-textured yarns are given in Table IX-2. After draw false-twist texturing, the filaments of Examples IX-2 and IX-7 had filament cross-sections in appearance similar to FIG. 3B. After draw false-twist texturing, the filaments of Examples IX-4 and IX-9 had filament cross-sections in appearance similar to FIG. 4B, and the filaments of Examples IX-3, IX-5, IX-8 and IX-10 had cross-sections in appearance similar to FIG. 5B. The draw-false-twist textured multilobal filaments having FF of at least 2 exhibited some lobe distortion from the texturing process, but retained in general filaments having distinct lobes and multiple along-filament grooves, said filaments providing low fabric glitter even after draw false-twist texturing.

Black-dyed, circular-knit fabrics were made from draw-textured yarns of Example IX using equivalent fabric construction and dyeing conditions. Fabrics were rated for relative glitter under bright sunlight viewing, and rated for relative color depth under diffuse room lighting. A reduction in glitter of fabrics made from these higher dpf yarns was achieved by increasing the level of added delusterant from 0.30% to 1.5%; however, the increase in $TiO_2$ reduced the relative color depth of the fabric, which was a disadvantage. A more significant reduction in fabric glitter was achieved, without the penalty of loss of fabric coloration, by modifying the fiber cross section and using lower delusterant level. Examples IX-6 and IX-8 through IX-10 had significantly reduced glitter and higher coloration when compared to yarns having the prior art octalobal cross-section, even when the prior art cross section was combined with high delusterant level. The fabrics made from Example IX multilobal yarns comprised of filaments with filament factor ≧2, even when fewer than 8 lobes were used, had glitter ratings generally superior to fabrics made from yarns comprised of filaments of the prior-art octalobal cross-section. The yarns comprised of 3-lobe filaments having negative lobe angles but with filament factors below 2 did not provide low fabric glitter. Fabric ratings are shown in Table IX-3.

TABLE IX-2

TEXTURED YARN PROPERTIES

| Ex. | Text. Denier | Text. dpf | Text. Tenacity (gpd) | Text. Elo. (%) | Text. Tb (gpd) | Leesona Shrinkage (%) | Fray Count (bf/1000 meters) |
|---|---|---|---|---|---|---|---|
| IX-A | 170 | 3.40 | 4.36 | 35.6 | 5.91 | 49.70 | 0.0 |
| IX-1 | 171 | 3.42 | 4.26 | 32.6 | 5.65 | 45.00 | 0.0 |
| IX-2 | 171 | 3.42 | 4.29 | 33.2 | 5.72 | 39.90 | 0.0 |
| IX-3 | 169 | 3.38 | 3.97 | 28.5 | 5.10 | 34.60 | 0.0 |
| IX-4 | 170 | 3.40 | 4.02 | 28.6 | 5.17 | 32.60 | 0.0 |
| IX-5 | 170 | 3.40 | 4.05 | 29.4 | 5.24 | 35.00 | 0.0 |
| IX-B | 168 | 3.36 | 4.21 | 34.4 | 5.66 | 37.40 | 0.0 |
| IX-C | 170 | 3.40 | 4.39 | 32.7 | 5.83 | 47.10 | 0.0 |
| IX-6 | 169 | 3.38 | 4.25 | 29.6 | 5.51 | 43.20 | 2.2 |
| IX-7 | 169 | 3.38 | 4.19 | 29.5 | 5.42 | 37.20 | 0.0 |
| IX-8 | 168 | 3.36 | 3.94 | 25.7 | 4.95 | 34.90 | 0.0 |
| IX-9 | 169 | 3.38 | 4.10 | 27.9 | 5.25 | 34.50 | 0.0 |
| IX-10 | 169 | 3.38 | 3.98 | 25.6 | 5.00 | 35.70 | 0.0 |
| IX-D | 168 | 3.36 | 4.14 | 32.4 | 5.48 | 37.30 | 0.2 |

TABLE IX-3

FABRIC RATINGS

| Ex. | Color Depth | Glitter Rating |
|---|---|---|
| IX-A | 11.3 | 11.7 |
| IX-1 | 9 | 27 |
| IX-2 | 9 | 12 |
| IX-3 | 3 | 32 |
| IX-4 | 3 | 32 |
| IX-5 | 3 | 31 |
| IX-B | 4 | 2 |
| IX-C | 28 | 10 |
| IX-6 | 27 | 24 |
| IX-7 | 26 | 10 |
| IX-8 | 19 | 23 |
| IX-9 | 22 | 25 |
| IX-10 | 23 | 27 |
| IX-D | 27 | 0 |

Example X

Basic-dyeable feed yarns comprised of 88 filaments of nominal 1.28 dpf were prepared using polymer essentially as described in Example V. Comparative Example X-A filaments had 4 symmetric lobes having negative lobe angles and having an average filament factor of 6.86. Example X-1 filaments had 4 lobes having negative lobe angles and having differing lobe heights by use of capillary slots having differing slot lengths. Opposing lobes were of essentially equal lobe height, while adjacent lobes were of differing heights. The ratio of modification ratios $M_1/M_2$ was used to quantify the relative difference in lobe heights, wherein $M_1$ was the modification ratio obtained using the outermost circle (reference "R" of FIG. 1), which circumscribes the longest opposing pair of lobes, and $M_2$ is the modification ratio obtained using the circle, which circumscribes the shortest opposing pair of lobes. The filament factor of Example X-1 was 5.27 if the lobe geometric parameters of the shortest lobes were used in the filament factor determination, and the filament factor was 8.83 if the lobe geometric parameters of the longest lobes were used in the filament factor determination. In either determination, the filament factor of the asymmetric cross-section Example X-1 was at least 2.0, and the average filament factor was at least 2.0. The filaments of Example X-1 had cross-sections in appearance similar to FIG. 12. Table X-1 contains a summary of yarns physical properties and filament geometric parameters.

Yarns of Example X were draw false-twist textured using a Barmag AFK texturing machine equipped with polyurethane discs and using 1.40 draw ratio, 1.80 D/Y ratio and a non-contact first heater at 220° C. The draw-textured yarns had a denier per filament (dpf) of approximately 0.89; i.e., the draw-textured filaments were "subdeniers" or "microfibers" by virtue of having denier per filament below 1. Both the symmetric and asymmetric cross section multifilament feed yarns had similar tensile properties, and the textured yarns had low levels of broken filaments and tensile properties suitable for fabric formation processes such as weaving and knitting. Table X-2 contains a summary of textured yarn physical properties.

Black-dyed, circular-knit fabrics were made from each draw-textured yarn X-A and X-1 using the same fabric construction and dyeing conditions. Fabrics were rated for relative glitter and shine under bright sunlight viewing, and rated for relative covering power under diffuse room lighting. The fabric using the Example X-1 yarn having the asymmetric cross-section filaments had similar low glitter to the fabric made using the symmetric cross-section filaments of Example X-A. The relative lobe heights of the multilobal filaments of the invention can be adjusted, for example as a means to influence filament-to-filament packing and moisture transport properties, without negating the improved luster properties of the filaments.

TABLE X-2

TEXTURED YARN PROPERTIES

| Ex. | Text. Denier | Text. dpf | Text. Tenacity (gpd) | Text. Elo. (%) | Text. Tb (gpd) | Leesona Shrinkage (%) | Fray Count (bf/1000 meters) |
|---|---|---|---|---|---|---|---|
| X-A | 78.5 | 0.89 | 2.73 | 28.4 | 3.50 | 12.50 | 3.3 |
| X-1 | 78.5 | 0.89 | 2.69 | 26.4 | 3.40 | 12.60 | 1.1 |

Example XI

Bicomponent filaments having three lobes and filament factor >2.0 were produced by bicomponent spinning of polyethylene terephthalate and polytrimethylene terephthalate polymers. The polymers were located within the filaments in intimate adherence and in side-by-side configuration, and each polymer component extended longitudinally through the length of the filaments. Multiple filaments were simultaneously extruded from a spinneret, and the filaments were formed into multifilament bundles and wound. Bicomponent filaments having cross-section configurations according to the present invention may be bulked as result of their latent crimpability without the need to mechanically texture the filaments, as is described in the art (e.g., U.S. Pat. No. 3,454,460).

Those skilled in the art, having the benefit of the teachings of the present invention as hereinabove set forth, can effect numerous modifications thereto. These modifications are to be construed as being encompassed within the scope of the present invention as set forth in the appended claims.

TABLE I-1

As-Spun Physical Properties

| Ex. | Denier | # Fils. | Spun dpf | Denier Spread (%) | Draw Tension (g) | Draw Tension (gpd) | Tenacity (gpd) | Elongation (%) | $T_s$ (gpd) | T7 (gpd) | Shrinkage @ Boil (%) |
|---|---|---|---|---|---|---|---|---|---|---|---|
| I-1 | 115.0 | 100 | 1.15 | 1.05 | 65.6 | 0.57 | 2.82 | 145.0 | 6.91 | 0.66 | 49.9 |
| I-A | 118.0 | 100 | 1.18 | 1.01 | 87.1 | 0.74 | 2.78 | 131.0 | 6.42 | | |
| I-B | 115.6 | 100 | 1.16 | | 69.0 | 0.60 | 2.80 | 131.0 | 6.47 | | |

Cross Section Description

| Ex. | # Lobes | MR | Lobe Angle (deg.) | Wrap Angle per lobe (deg.) | Angle Factor | Tip Ratio | Lobe Area Factor | Filament Factor |
|---|---|---|---|---|---|---|---|---|
| I-1 | 3 | 2.09 | −37.4 | 217 | 52.4 | 0.445 | 2.235 | 2.572 |
| I-A | 3 | 1.89 | 19.8 | 160 | −4.8 | 0.342 | 1.443 | 0.838 |
| I-B | 1 | 1.00 | −180.0 | 360 | 195.0 | 1 | 1.156 | 0.112 |

TABLE II-1

As-Spun Physical Properties

| Ex. | Denier | # Fils. | Spun dpf | Denier Spread (%) | Draw Tension (g) | Draw Tension (gpd) | Tenacity (gpd) | Elongation (%) | $T_B$ (gpd) | T7 (gpd) | Shrinkage @ Boil (%) |
|---|---|---|---|---|---|---|---|---|---|---|---|
| II-1 | 248.1 | 200 | 1.24 | 1.31 | 113.6 | 0.46 | 2.70 | 160.8 | 7.04 | 0.61 | 55.8 |
| II-A | 253.3 | 200 | 1.27 | 1.15 | 151.2 | 0.60 | 2.65 | 141.5 | 6.40 | | |
| II-B | 226.0 | 200 | 1.13 | | 107.0 | 0.47 | 2.45 | 142.0 | 5.93 | | |

TABLE II-1-continued

| | Cross Section Description | | | | | | | |
|---|---|---|---|---|---|---|---|---|
| Ex. | # Lobes | MR | Lobe Angle (deg.) | Wrap Angle per lobe (deg.) | Angle Factor | Tip Ratio | Lobe Area Factor | Filament Factor |
| II-1 | 3 | 2.08 | −35.4 | 215 | 50.4 | 0.441 | 2.367 | 2.373 |
| II-A | 3 | 1.91 | 18.6 | 161 | −3.6 | 0.349 | 1.615 | 0.773 |
| II-B | 1 | 1.00 | −180.0 | 360 | 195.0 | 1 | 1.130 | 0.113 |

TABLE III-1

| | As-Spun Physical Properties | | | | | | | | | | |
|---|---|---|---|---|---|---|---|---|---|---|---|
| Ex. | Denier | # Fils. | Spun dpf | Denier Spread (%) | Draw Tension (g) | Draw Tension (gpd) | Tenacity (gpd) | Elongation (%) | $T_s$ (gpd) | T7 (gpd) | Shrinkage @ Boil (%) |
| III-1 | 246.8 | 176 | 1.40 | 1.21 | 111.6 | 0.45 | 2.23 | 135.0 | 5.24 | 0.61 | 54.4 |
| III-A | 246.6 | 176 | 1.40 | 1.42 | 115.1 | 0.47 | 2.43 | 150.5 | 6.09 | | |
| III-2 | 245.9 | 176 | 1.40 | 1.15 | 113.1 | 0.46 | 2.38 | 139.2 | 5.69 | | |

| | Cross Section Description | | | | | | | |
|---|---|---|---|---|---|---|---|---|
| Ex. | # Lobes | MR | Lobe Angle (deg.) | Wrap Angle per lobe (deg.) | Angle Factor | Tip Ratio | Lobe Area Factor | Filament Factor |
| III-1 | 3 | 2.21 | −39.0 | 219 | 54.0 | 0.448 | 3.057 | 2.473 |
| III-A | 1 | 1.0 | −180.0 | 360 | 195.0 | 1 | 1.399 | 0.104 |
| III-2 | 3 | 2.39 | −59.9 | 240 | 74.9 | 0.456 | 3.644 | 3.534 |

TABLE IV-1

| | As-Spun Physical Properties | | | | | | | | | | |
|---|---|---|---|---|---|---|---|---|---|---|---|
| Ex. | Denier | # Fils. | Spun dpf | Denier Spread (%) | Draw Tension (g) | Draw Tention (gpd) | Tenacity (gpd) | Elongation (%) | $T_B$ (gpd) | T7 (gpd) | Shrinkage @ Boil (%) |
| IV-1 | 73.9 | 88 | 0.84 | 1.53 | 105.9 | 1.43 | 2.47 | 68.04 | 4.15 | 1.29 | 3.2 |
| IV-A | 74.5 | 100 | 0.75 | 1.22 | 108.4 | 1.46 | 2.63 | 73.3 | 4.55 | 1.33 | 3.6 |
| IV-2 | 74.7 | 100 | 0.75 | 1.33 | 109.2 | 1.46 | 2.36 | 57.6 | 3.72 | 1.39 | 3.5 |
| IV-B | 75.5 | 100 | 0.75 | 1.45 | 110.5 | 1.46 | 2.23 | 49.8 | 3.34 | 1.44 | 3.1 |
| IV-C | 74.2 | 34 | 2.18 | 1.46 | 80.1 | 1.08 | 2.69 | 90.6 | 5.13 | 0.97 | 3.3 |

| | Cross Section Description | | | | | | | |
|---|---|---|---|---|---|---|---|---|
| Ex. | # Lobes | MR | Lobe Angle (deg.) | Wrap Angle per lobe (deg.) | Angle Factor | Tip Ratio | Lobe Area Factor | Filament Factor |
| IV-1 | 3 | 2.65 | −49.8 | 230 | 64.8 | 0.43 | 2.527 | 5.011 |
| IV-A | 1 | 1.0 | −180.0 | 360 | 195.0 | 1 | 0.745 | 0.132 |
| IV-2 | 3 | 2.15 | −39.0 | 219 | 54.0 | 0.451 | 1.560 | 3.692 |
| IV-B | 3 | 1.96 | 21.9 | 158 | −6.9 | 0.312 | 0.902 | 1.762 |
| IV-C | 3 | 1.95 | 25.4 | 155 | −10.4 | 0.327 | 2.720 | 0.207 |

TABLE V-1

| | As-Spun Physical Properties | | | | | | | | | | |
|---|---|---|---|---|---|---|---|---|---|---|---|
| Ex. | Denier | # Fils. | Spun dpf | Denier Spread (%) | Draw Tension (g) | Draw Tension (gpd) | Tenacity (gpd) | Elongation (%) | $T_s$ (gpd) | T7 (gpd) | Shrinkage @ Boil (%) |
| V-1 | 115.0 | 88 | 1.31 | 0.79 | 66.4 | 0.58 | 1.95 | 134.1 | 4.57 | 0.63 | 48.9 |
| V-A | 114.9 | 100 | 1.15 | 0.65 | 66.4 | 0.58 | 2.02 | 137.2 | 4.79 | 0.64 | 50.1 |
| V-B | 115.1 | 100 | 1.15 | 0.98 | 79.9 | 0.69 | 1.95 | 120.8 | 4.31 | 0.68 | 44.1 |

TABLE V-1-continued

| | | | | | | | | | | | |
|---|---|---|---|---|---|---|---|---|---|---|---|
| V-2 | 114.9 | 100 | 1.15 | 0.81 | 69.3 | 0.60 | 2.02 | 137.0 | 4.79 | 0.64 | 48.5 |

| | Cross Section Description | | | | | | | |
|---|---|---|---|---|---|---|---|---|
| Ex. | # Lobes | MR | Lobe Angle (deg.) | Wrap Angle per lobe (deg.) | Angle Factor | Tip Ratio | Lobe Area Factor | Filament Factor |
| V-1 | 3 | 2.36 | −44.2 | 224 | 59.2 | 0.473 | 3.432 | 2.973 |
| V-A | 1 | 1.0 | −180.0 | 360 | 195.0 | 1 | 1.149 | 0.112 |
| V-B | 3 | 1.92 | 26.8 | 153 | −11.8 | 0.328 | 1.394 | 0.720 |
| V-2 | 3 | 2.16 | −42.2 | 222 | 57.2 | 0.49 | 2.625 | 2.770 |

TABLE VI-1

| | As-Sun Physical Properties | | | | | | | | | | |
|---|---|---|---|---|---|---|---|---|---|---|---|
| Ex. | Denier | # Fils. | Spun dpf | Denier Spread (%) | Draw Tension (g) | Draw Tension (gpd) | Tenacity (gpd) | Elongation (%) | $T_B$ (gpd) | T7 (gpd) | Shrinkage @ Boil (%) |
| VI-A | 80.3 | 34 | 2.36 | 0.86 | 28.4 | 0.35 | 1.90 | 160.4 | 4.95 | 0.57 | 49.9 |
| VI-B | 80.6 | 34 | 2.37 | 0.87 | 38.0 | 0.47 | 1.44 | 129.2 | 3.30 | 0.60 | 47.1 |
| VI-1 | 80.9 | 34 | 2.38 | 0.84 | 47.6 | 0.59 | 1.83 | 131.3 | 4.23 | 0.63 | 41.4 |
| VI-2 | 80.9 | 34 | 2.38 | 0.75 | 43.5 | 0.54 | 1.67 | 115.4 | 3.60 | 0.61 | 42.4 |

| | Cross Section Description | | | | | | | |
|---|---|---|---|---|---|---|---|---|
| Ex. | # Lobes | MR | Lobe Angle (deg.) | Wrap Angle per lobe (deg.) | Angle Factor | Tip Ratio | Lobe Area Factor | Filament Factor |
| VI-A | 1 | 1.0 | −180.0 | 360 | 195.0 | 1 | 2.362 | 0.086 |
| VI-B | 3 | 2.16 | 19.7 | 160 | −4.7 | 0.28 | 3.083 | 0.389 |
| VI-1 | 6 | 1.36 | −9.1 | 189 | 24.1 | 0.348 | 1.527 | 6.978 |
| VI-2 | 3 | 3.37 | −52.6 | 233 | 67.6 | 0.398 | 10.767 | 4.072 |

TABLE VII-1

| | As-Spun Physical Properties | | | | | | | | | | |
|---|---|---|---|---|---|---|---|---|---|---|---|
| Ex. | Denier | # Fils. | Spun dpf | Denier Spread (%) | Draw Tension (g) | Draw Tension (gpd) | Tenac-ity (gpd) | Elonga-tion (%) | $T_s$ (gpd) | T7 (gpd) | Shrinkage @ Boil (%) |
| VII-A | 64.8 | 34 | 1.91 | 1.19 | 26.9 | 0.42 | 1.92 | 153.8 | 4.87 | 0.59 | 53.1 |
| VII-B | 65.1 | 34 | 1.91 | 1.32 | 35.5 | 0.55 | 1.69 | 119.7 | 3.71 | 0.63 | 48.1 |
| VII-1 | 65.0 | 34 | 1.91 | 1.11 | 43.6 | 0.67 | 1.87 | 123.2 | 4.17 | 0.65 | 41.3 |
| VII-2 | 64.8 | 34 | 1.91 | 1.28 | 40.3 | 0.62 | 1.77 | 113.3 | 3.77 | 0.64 | 38.9 |
| VII-C | 65.6 | 50 | 1.31 | 1.31 | 43.0 | 0.66 | 1.81 | 115.3 | 3.90 | 0.67 | 37.7 |
| VII-3 | 68.4 | 50 | 1.31 | 1.03 | 53.6 | 0.82 | 1.96 | 115.9 | 4.23 | 0.75 | 28.2 |

| | Cross Section Description | | | | | | | |
|---|---|---|---|---|---|---|---|---|
| Ex. | # Lobes | MR | Lobe Angle (deg.) | Wrap Angle per lobe (deg.) | Angle Factor | Tip Ratio | Lobe Area Factor | Filament Factor |
| VII-A | 1 | 1.0 | −180.0 | 360 | 195.0 | 1 | 1.906 | 0.093 |
| VII-B | 3 | 2.00 | 19.2 | 161 | −4.2 | 0.298 | 2.279 | 0.500 |
| VII-1 | 6 | 1.35 | −7.7 | 188 | 22.7 | 0.339 | 1.187 | 8.858 |
| VII-2 | 3 | 3.25 | −51.3 | 231 | 66.3 | 0.411 | 8.242 | 4.210 |
| VII-C | 3 | 1.87 | 24.8 | 155 | −9.8 | 0.303 | 1.383 | 0.681 |
| VII-3 | 6 | 1.25 | 22.8 | 157 | −7.8 | 0.326 | 0.670 | 10.215 |

TABLE VIII-1

| | As-Spun Physical Properties | | | | | | | | | | |
|---|---|---|---|---|---|---|---|---|---|---|---|
| Ex. | Denier | # Fils. | Spun dpf | Denier Spread (%) | Draw Tension (g) | Draw Tension (gpd) | Tenacity (gpd) | Elongation (%) | $T_B$ (gpd) | T7 (gpd) | Shrinkage @ Boil (%) |
| VIII-A | 71.5 | 100 | 0.72 | 1.60 | 77.1 | 1.08 | 2.19 | 74.2 | 3.82 | 1.29 | 8.4 |
| VIII-1 | 71.5 | 100 | 0.72 | 1.53 | 75.5 | 1.06 | 2.08 | 66.2 | 3.46 | 1.28 | 8.6 |
| VIII-B | 71.7 | 50 | 1.43 | 1.40 | 63.4 | 0.88 | 1.80 | 63.9 | 2.95 | 1.08 | 6.4 |
| VIII-2 | 71.7 | 50 | 1.43 | 1.65 | 68.9 | 0.96 | 1.88 | 62.9 | 3.06 | 1.20 | 6.0 |
| VIII-C | 71.9 | 68 | 1.06 | 1.60 | 70.4 | 0.98 | 1.82 | 56.8 | 2.85 | 1.21 | 7.6 |
| VIII-3 | 72.0 | 68 | 1.06 | 1.44 | 73.4 | 1.02 | 1.89 | 59.0 | 3.01 | 1.28 | 7.0 |
| VIII-4 | 49.7 | 50 | 0.99 | 1.59 | 54.3 | 1.09 | 1.98 | 62.5 | 3.22 | 1.40 | 5.1 |
| VIII-5 | 47.5 | 68 | 0.70 | 2.02 | 58.8 | 1.24 | 1.93 | 48.7 | 2.87 | 1.51 | 5.6 |

| | Cross Section Desription | | | | | | | |
|---|---|---|---|---|---|---|---|---|
| Ex. | # Lobes | MR | Lobe Angle (deg.) | Wrap Angle per lobe (deg.) | Angle Factor | Tip Ratio | Lobe Area Factor | Filament Factor |
| VIII-A | 1 | 1.00 | −180 | 360 | 195.0 | 1 | 1.906 | 0.093 |
| VIII-1 | 3 | 2.41 | −51.0 | 231 | 66.0 | 0.45 | 1.863 | 4.948 |
| VIII-B | 3 | 2.02 | 23.2 | 157 | −8.2 | 0.283 | 1.656 | 0.715 |
| VIII-2 | 6 | 1.44 | −1.3 | 181 | 16.3 | 0.331 | 0.983 | 12.479 |
| VIII-C | 3 | 2.24 | 19.7 | 160 | −4.7 | 0.281 | 1.489 | 1.391 |
| VIII-3 | 3 | 2.81 | −40.8 | 221 | 55.8 | 0.424 | 3.541 | 4.209 |
| VIII-4 | 6 | 1.33 | 4.8 | 175 | 10.2 | 0.347 | 0.605 | 16.762 |
| VIII-5 | 3 | 2.54 | −46.1 | 226 | 61.1 | 0.422 | 1.898 | 5.246 |

TABLE IX-1

| | As-Spun Physical Properties | | | | | | | | | |
|---|---|---|---|---|---|---|---|---|---|---|
| Ex. | Denier | # Fils. | Spun dpf | Denier Spread (%) | Draw Tension (g) | Draw Tension (gpd) | Tenacity (gpd) | Elongation (%) | $T_B$ (gpd) | T7 (gpd) |
| IX-A | 256.7 | 50 | 5.13 | 1.08 | 146.5 | 0.57 | 2.52 | 129.7 | 5.79 | 0.58 |
| IX-1 | 256.2 | 50 | 5.12 | 1.00 | 155.2 | 0.61 | 2.44 | 127.4 | 5.55 | 0.59 |
| IX-2 | 256.6 | 50 | 5.13 | 1.15 | 150.5 | 0.59 | 2.41 | 124.8 | 5.42 | 0.59 |
| IX-3 | 255.5 | 50 | 5.11 | 1.01 | 148.9 | 0.58 | 2.34 | 119.5 | 5.14 | 0.58 |
| IX-4 | 255.7 | 50 | 5.11 | 1.02 | 150.2 | 0.59 | 2.34 | 119.3 | 5.13 | 0.59 |
| IX 5 | 254.6 | 50 | 5.09 | 0.94 | 151.5 | 0.59 | 3.25 | 122.3 | 5.00 | 0.60 |
| IX-B | 253.5 | 50 | 5.07 | 1.09 | 118.8 | 0.47 | 2.31 | 126.7 | 5.24 | 0.57 |
| IX-C | 255.1 | 50 | 5.10 | 0.86 | 142.3 | 0.56 | 2.40 | 119.9 | 5.28 | 0.54 |
| IX-6 | 254.1 | 50 | 5.08 | 0.90 | 152.8 | 0.60 | 2.34 | 116.8 | 5.07 | 0.55 |
| IX-7 | 253.3 | 50 | 5.07 | 0.87 | 149.0 | 0.59 | 2.31 | 102.5 | 4.68 | 0.55 |
| IX-8 | 253.0 | 50 | 5.06 | .98 | 149.0 | 0.59 | 2.04 | 108.2 | 4.25 | 0.54 |
| IX-9 | 253.2 | 50 | 5.06 | 1.00 | 147.8 | 0.58 | 2.10 | 104.9 | 4.30 | 0.54 |
| IX-10 | 252.8 | 50 | 5.06 | 0.98 | 149.7 | 0.59 | 2.09 | 105.3 | 4.29 | 0.55 |
| IX-D | 252.7 | 50 | 5.05 | 0.96 | 111.9 | 0.44 | 2.22 | 119.5 | 4.87 | 0.51 |

| | Cross Section Description | | | | | | | |
|---|---|---|---|---|---|---|---|---|
| Ex. | # Lobes | MR | Lobe Angle (deg.) | Wrap Angle per lobe (deg.) | Angle Factor | Tip Ratio | Lobe Area Factor | Filament Factor |
| IX-A | 8 | 1.17 | 90.5 | 90 | −75.5 | 0.321 | 2.262 | −3.360 |
| IX-1 | 8 | 1.25 | 49.0 | 131 | −34.0 | 0.26 | 2.083 | 2.700 |
| IX-2 | 6 | 1.35 | −19.6 | 200 | 34.6 | 0.348 | 3.244 | 4.000 |
| IX-3 | 6 | 1.41 | 4.5 | 176 | 10.5 | 0.317 | 3.238 | 2.716 |
| IX-4 | 6 | 1.56 | 2.5 | 178 | 12.5 | 0.273 | 3.408 | 3.507 |
| IX 5 | 6 | 1.55 | 13.2 | 167 | 1.8 | 0.265 | 3.223 | 2.697 |
| IX-B | 3 | 2.20 | −40.1 | 220 | 55.1 | 0.473 | 11.621 | 1.283 |
| IX-C | 8 | 1.21 | 86.0 | 94 | −71.0 | 0.287 | 2.131 | −2.390 |
| IX-6 | 8 | 1.32 | 29.7 | 150 | −14.7 | 0.24 | 2.125 | 6.025 |
| IX-7 | 6 | 1.48 | −18.8 | 199 | 33.8 | 0.342 | 3.783 | 4.486 |
| IX-8 | 6 | 1.57 | 17.8 | 162 | −2.8 | 0.262 | 3.264 | 2.394 |
| IX-9 | 6 | 1.70 | 3.8 | 176 | 11.2 | 0.248 | 3.627 | 4.006 |
| IX-10 | 6 | 1.57 | 6.0 | 174 | 9.0 | 0.26 | 3.230 | 3.396 |
| IX-D | 3 | 2.26 | −38.9 | 219 | 53.9 | 0.453 | 11.728 | 1.316 |

TABLE X-1

| | As-Spun Physical Properties | | | | | | | | | |
|---|---|---|---|---|---|---|---|---|---|---|
| Ex. | Denier | # Fils. | Spun dpf | Denier Spread (%) | Draw Tension (g) | Draw Tension (gpd) | Tenacity (gpd) | Elongation (%) | TB (gpd) | T7 (gpd) |
| IX-A | 112.6 | 88 | 1.28 | 1.31 | 77.8 | 0.69 | 1.92 | 124 | 4.3 | 0.63 |
| IX-1 | 112.7 | 88 | 1.28 | 1.63 | 77.6 | 0.69 | 1.98 | 132.6 | 4.61 | 0.63 |

| | Cross Section Description | | | | | | | | | | | | | |
|---|---|---|---|---|---|---|---|---|---|---|---|---|---|---|
| Ex. | # Lobes | MR1 | MR2 | MR1/ MR2 | Lobe Angle 1 (deg.) | Lobe Angle 2 (deg.) | Angle Factor 1 | Angle Factor 2 | Tip Ratio 1 | Tip Ratio 2 | Lobe Area Factor 1 | Lobe Area Factor 2 | Filament Factor 1 | Filament Factor 2 |
| IX-A | 4 | 2.291 | n.a. | | −33.9 | n.a. | 48.9 | n.a. | 0.4 | n.a. | 2.559 | n.a. | 6.857 | n.a. |
| IX-1 | 4 | 2.566 | 2.05 | 1.25 | −38.8 | −23.6 | 53.8 | 38.6 | 0.3 | 0.385 | 2.774 | 2.064 | 8.829 | 5.27 |

What is claimed is:

1. A synthetic filament having a multilobal cross-section, a filament factor of about 2 or greater, wherein the filament factor is determined according to the following formula:

$$FF=K_1*(MR)^A*(N)^B*(1/(DPF)^C*[K_2*(N)D*(MR)^E*1/(LAF)+K_3*(AF)],$$

wherein $K_1$ is 0.0013158; $K_2$ is 2.1; $K_3$ is 0.45; A is 1.5; B is 2.7; C is 0.35; D is 1.4; E is 1.3; MR is $R/r_1$, wherein R is the radius of a circle centered in the middle of the cross-section and circumscribed about the tips of the lobes, and $r_1$ is the radius of a circle centered in the middle of the cross-section and inscribed within the cross-section about the connecting points of the lobes; N is the number of lobes in the cross-section; DPF is the denier per filament; LAF is $(TR)*(DPF)*(MR)^2$, wherein TR is $r_2/R$, wherein $r_2$ is the average radius of a circle inscribed about the lobes, and R is as set forth above, and DPF and MR are as set forth above; and AF is 15 minus the lobe angle, wherein the lobe angle is the average angle of two tangent lines laid at the point of inflection of curvature on each side of the lobes of the filament cross-section, and an average tip ratio of about 0.2.

2. The filament of claim 1, wherein the tip ratio is ≧ about 0.3.

3.The filament of claim 2, wherein the tip ratio is ≧ about 0.4.

4. The filament of claim 1, wherein the lobe angle is ≦ about 15°.

5. The filament of claim 1, wherein said lobe angle is ≦ about 0°.

6. The filament of claim 4, wherein said lobe angle is ≦ about −30°.

7. The filament of claim 1, wherein said filament is comprised of at least one melt-spinnable polymer selected from the group consisting of polyesters, polyamides, polyolefins, and combinations thereof.

8. The filament of claim 7, wherein said polymer is a polyester selected from the group consisting of polyethylene terephthalate, polytrimethylene terephthalate, polytrimethylene terephthalate, polybutylene terephthalate, polyproplylene terephthalate, polyethylene napthalate, and combinations thereof.

9. The filament of claim 1, wherein said filament has a filament factor of greater than or equal to about 3.0.

10. The filament of claim 9, wherein said filament has a filament factor of greater than or equal to 4.0.

11. The filament of claim 1, wherein said filament has 3 to 8 lobes.

12. The filament of claim 1, wherein the filament has a denier in the range of between about 0.2 to about 5.0 denier per filament.

* * * * *